US011731794B2

(12) United States Patent
Neeser et al.

(10) Patent No.: US 11,731,794 B2
(45) Date of Patent: Aug. 22, 2023

(54) STRAPPING DEVICE

(71) Applicant: Signode Industrial Group LLC, Tampa, FL (US)

(72) Inventors: Mirco Neeser, Ehrendingen (CH); Roland Widmer, Haar (DE); Flavio Finzo, Wurenlos (CH)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 18/058,011

(22) Filed: Nov. 22, 2022

(65) Prior Publication Data

US 2023/0150703 A1 May 18, 2023

Related U.S. Application Data

(63) Continuation of application No. 16/677,266, filed on Nov. 7, 2019, now Pat. No. 11,530,059, which is a (Continued)

(30) Foreign Application Priority Data

Apr. 23, 2008 (CH) ..... 645/08
Apr. 23, 2008 (CH) ..... 646/08
(Continued)

(51) Int. Cl.
*B65B 13/22* (2006.01)
*B65B 13/32* (2006.01)
(Continued)

(52) U.S. Cl.
CPC ..... *B65B 13/187* (2013.01); *B65B 13/025* (2013.01); *B65B 13/22* (2013.01); *B65B 13/322* (2013.01)

(58) Field of Classification Search
CPC ..... B65B 13/22; B65B 13/32; B65B 13/322; B65B 13/025; B65B 13/187
(Continued)

(56) References Cited

U.S. PATENT DOCUMENTS 2,134,186 A * 10/1938 Harvey ..... B65B 13/22 100/31
2,936,156 A 5/1960 Coupland
(Continued)

FOREIGN PATENT DOCUMENTS

CA 2432353 A1 12/2003
CH 705745 A2 5/2013
(Continued)

OTHER PUBLICATIONS

"Description of the Operating Sequence of the Cyklop CB 130 Tool", The Cyklop CB 130 Tool was publicly available before the priority date of the present application.
(Continued)

*Primary Examiner* — Jimmy T Nguyen
(74) *Attorney, Agent, or Firm* — Neal, Gerber & Eisenberg LLP

(57) ABSTRACT

A strapping device including a tensioner operable to apply a strap tension to a loop of wrapping strap, a friction welder operable to produce a friction weld connection at two areas of the loop of wrapping strap disposed one on top of the other, a motor operable in a first rotational direction to drive the tensioner and in a second opposite rotational direction to drive the friction welder, and a control device. The control device is configured to, in response to receiving a first designated input: (1) operate the motor in the first rotational direction to drive the tensioner until a predetermined strap tension is reached in the loop of wrapping strap; and (2) afterwards, automatically operate the motor in the second
(Continued)

different rotational direction to drive the friction welder to produce the friction weld connection.

60 Claims, 11 Drawing Sheets

Related U.S. Application Data continuation of application No. 14/918,167, filed on Oct. 20, 2015, now Pat. No. 10,518,914, which is a continuation of application No. 12/989,112, filed as application No. PCT/CH2009/000001 on Jan. 6, 2009, now Pat. No. 9,174,752, said application No. 14/918,167 is a continuation of application No. 12/989,142, filed as application No. PCT/CH2009/000002 on Jan. 6, 2009, now Pat. No. 9,284,080, said application No. 14/918,167 is a continuation of application No. 12/989,181, filed as application No. PCT/CH2009/000003 on Jan. 6, 2009, now Pat. No. 9,315,283, said application No. 14/918,167 is a continuation of application No. 12/989,281, filed as application No. PCT/CH2009/000004 on Jan. 6, 2009, now Pat. No. 9,193,486, said application No. 14/918,167 is a continuation of application No. 12/989,355, filed as application No. PCT/CH2009/000005 on Jan. 6, 2009, now Pat. No. 9,254,932.

(30) Foreign Application Priority Data

Apr. 23, 2008 (CH) ..... 647/08
Apr. 23, 2008 (CH) ..... 648/08
Apr. 23, 2008 (CH) ..... 649/08

(51) Int. Cl.
*B65B 13/18* (2006.01)
*B65B 13/02* (2006.01)

(58) Field of Classification Search
USPC ..... 100/29, 32, 33 PB, 33 R, 30
See application file for complete search history.

(56) References Cited

U.S. PATENT DOCUMENTS 3,013,589 A 12/1961 Holford
3,028,885 A 4/1962 Leslie et al.
3,081,655 A 3/1963 Mitsuji et al.
3,367,374 A 2/1968 Meier et al.
3,442,733 A 5/1969 Vilcins
3,526,187 A * 9/1970 Gilliard ..... B65B 13/22 100/30
3,586,572 A 6/1971 Ericsson
3,654,033 A 4/1972 Angarola et al.
3,674,972 A 7/1972 Stahnke
3,755,045 A 8/1973 Takami
4,011,807 A 3/1977 Kobiella
4,015,643 A 4/1977 Cheung
4,037,073 A 7/1977 Becker
4,050,372 A 9/1977 Kobiella
4,079,667 A 3/1978 Lems et al.
4,080,082 A 3/1978 Angarola
4,161,910 A 7/1979 Leslie et al.
4,240,865 A 12/1980 Kyts
4,282,907 A 8/1981 Massion et al.
4,305,774 A 12/1981 Wedeking et al.
4,313,779 A 2/1982 Nix
4,450,032 A 5/1984 Wehr
4,488,926 A 12/1984 Rauch et al.
4,495,972 A 1/1985 Walker
4,516,488 A 5/1985 Bartzick et al.
4,534,817 A 8/1985 O'Sullivan
4,535,730 A 8/1985 Allen
4,572,064 A 2/1986 Burton
4,624,179 A 11/1986 Yves et al.
4,691,498 A 9/1987 Stamm
4,707,390 A 11/1987 Cheung
4,776,905 A 10/1988 Cheung et al.
4,820,363 A 4/1989 Fischer
4,912,912 A 4/1990 Tagomori
4,934,261 A 6/1990 Niedrig
4,952,271 A 8/1990 Cheung et al.
5,083,412 A 1/1992 Sakaki et al.
5,133,532 A 7/1992 Figiel et al.
5,140,126 A 8/1992 Ishibashi
5,141,591 A 8/1992 Boek et al.
5,146,847 A 9/1992 Lyon et al.
5,155,982 A 10/1992 Boek et al.
5,159,218 A 10/1992 Murry et al.
5,165,532 A 11/1992 Pipich et al.
5,226,461 A 7/1993 Macartney et al.
5,299,407 A 4/1994 Schuttler et al.
5,333,438 A 8/1994 Gurak et al.
5,350,472 A 9/1994 Koblella
5,379,576 A 1/1995 Koyama
5,380,393 A 1/1995 Drabarek et al.
5,509,594 A 4/1996 Maggioni
5,516,022 A 5/1996 Annis
5,518,043 A 5/1996 Cheung et al.
5,560,187 A 10/1996 Nagashima et al.
5,653,059 A 8/1997 Wecke et al.
5,653,095 A 8/1997 Stamm
5,689,943 A 11/1997 Wehr
5,690,023 A 11/1997 Stamm et al.
5,743,310 A * 4/1998 Moran ..... B65B 13/025 140/123.6
5,791,238 A 8/1998 Garbotz
5,798,596 A 8/1998 Lordo
5,809,873 A 9/1998 Chak et al.
5,853,524 A 12/1998 Nix
5,880,424 A 3/1999 Katoh
5,944,064 A 8/1999 Saito et al.
5,947,166 A 9/1999 Doyle et al.
5,954,899 A 9/1999 Figiel et al.
6,003,578 A 12/1999 Chang
6,032,440 A 3/2000 Luedtke
6,041,698 A 3/2000 Chin-Chang et al.
6,109,325 A 8/2000 Chang
6,131,634 A 10/2000 Chang
6,145,286 A 11/2000 Huber
6,173,557 B1 1/2001 Kuei
6,260,337 B1 7/2001 Cheung
6,305,277 B1 10/2001 Witczak et al.
6,308,745 B1 10/2001 Angarola et al.
6,308,760 B1 10/2001 Finzo et al.
6,328,087 B1 12/2001 Finzo et al.
6,332,306 B1 12/2001 Finzo et al.
6,334,563 B1 1/2002 Schwede
6,338,184 B1 1/2002 Angarola et al.
6,338,375 B1 1/2002 Harada
6,345,648 B1 2/2002 Cheung
6,401,764 B1 6/2002 Bell
6,405,766 B1 6/2002 Benjey
6,405,917 B1 6/2002 Mann
6,463,848 B1 10/2002 Haberstroh et al.
6,478,065 B1 11/2002 Haberstroh et al.
6,516,715 B1 2/2003 Reiche
6,532,722 B2 3/2003 Gerhart et al.
6,533,013 B1 3/2003 Nix
6,543,341 B2 4/2003 Lopez
6,568,158 B2 5/2003 Shibazaki et al.
6,571,531 B2 6/2003 Kasel
6,575,086 B2 6/2003 Pearson et al.
6,578,337 B2 6/2003 Scholl et al.
6,584,891 B1 7/2003 Smith et al.
6,584,892 B2 7/2003 Flaum et al.
6,606,766 B2 8/2003 Ko
6,607,158 B1 8/2003 Fischer
6,629,398 B2 10/2003 Pearson et al.
6,644,713 B2 11/2003 Del et al.

(56) References Cited

U.S. PATENT DOCUMENTS

| | | | |
|---|---|---|---|
| 6,668,516 | B2 | 12/2003 | Sakaki et al. |
| 6,698,460 | B2 | 3/2004 | Marsche |
| 6,708,606 | B1 | 3/2004 | Bell et al. |
| 6,715,375 | B2 | 4/2004 | Nestler |
| 6,729,357 | B2 | 5/2004 | Marsche |
| 6,732,638 | B1 | 5/2004 | Rometty et al. |
| 6,745,677 | B2 | 6/2004 | Pearson et al. |
| 6,817,159 | B2 | 11/2004 | Sakaki et al. |
| 6,820,402 | B1 | 11/2004 | Haberstroh et al. |
| 6,848,239 | B2 | 2/2005 | Shibazaki et al. |
| 6,848,241 | B2 | 2/2005 | Lopez |
| 6,857,252 | B2 | 2/2005 | Haberstroh et al. |
| 6,871,584 | B2 | 3/2005 | Pearson |
| 6,904,841 | B2 | 6/2005 | Bobren et al. |
| 6,907,717 | B2 | 6/2005 | Nix |
| 6,911,799 | B2 | 6/2005 | Jensen |
| 6,918,235 | B2 | 7/2005 | Nix |
| 6,923,113 | B2 | 8/2005 | Bobren et al. |
| 6,935,227 | B2 | 8/2005 | Lopez et al. |
| 6,945,164 | B2 | 9/2005 | Kobiella et al. |
| 6,951,170 | B2 | 10/2005 | Lininger et al. |
| 6,955,119 | B2 | 10/2005 | Bobren et al. |
| 6,962,109 | B2 | 11/2005 | Bobren et al. |
| 6,981,353 | B2 | 1/2006 | Haberstroh et al. |
| 7,007,597 | B1 | 3/2006 | Thas et al. |
| 7,011,000 | B2 | 3/2006 | Kushida et al. |
| 7,073,431 | B1 | 7/2006 | Chen |
| 7,121,193 | B2 | 10/2006 | Balling et al. |
| 7,128,099 | B2 | 10/2006 | Finzo |
| 7,234,394 | B1 | 6/2007 | Bell et al. |
| 7,237,478 | B1 | 7/2007 | Gosis et al. |
| 7,249,862 | B2 | 7/2007 | Shirane |
| 7,270,055 | B1 | 9/2007 | Haberstroh et al. |
| 7,312,609 | B2 | 12/2007 | Schmollngruber et al. |
| 7,377,213 | B1 | 5/2008 | Haberstroh et al. |
| 7,383,765 | B2 | 6/2008 | Kirar et al. |
| 7,395,754 | B1 | 7/2008 | Bobren et al. |
| 7,428,865 | B1 | 9/2008 | Kasel et al. |
| 7,428,867 | B1 | 9/2008 | Bell |
| 7,454,877 | B2 | 11/2008 | Morrison |
| 7,456,608 | B2 | 11/2008 | Kageler et al. |
| 7,497,068 | B2 | 3/2009 | Nasiatka et al. |
| 7,549,198 | B2 | 6/2009 | Gosis et al. |
| 7,681,496 | B2 | 3/2010 | Takidis et al. |
| 7,798,060 | B2 | 9/2010 | Pearson et al. |
| 8,198,839 | B2 | 6/2012 | Katou et al. |
| 8,287,672 | B2 | 10/2012 | Neeser et al. |
| 8,378,600 | B2 | 2/2013 | Katou et al. |
| 8,516,780 | B2 | 8/2013 | Derks |
| 9,174,752 | B2 | 11/2015 | Neeser et al. |
| 9,193,486 | B2 | 11/2015 | Neeser et al. |
| 9,254,932 | B2 | 2/2016 | Neeser et al. |
| 9,284,080 | B2 | 3/2016 | Neeser et al. |
| 9,315,283 | B2 | 4/2016 | Neeser et al. |
| 2002/0100146 | A1 | 8/2002 | Ko |
| 2002/0129717 | A1 | 9/2002 | Helland et al. |
| 2002/0134811 | A1 | 9/2002 | Napier et al. |
| 2003/0010225 | A1 | 1/2003 | Pearson et al. |
| 2003/0028289 | A1 | 2/2003 | Daniel et al. |
| 2003/0131570 | A1 | 7/2003 | Scholl et al. |
| 2003/0145900 | A1 | 8/2003 | Jensen et al. |
| 2003/0230058 | A1 | 12/2003 | Nix |
| 2004/0060259 | A1 | 4/2004 | Shibazaki et al. |
| 2004/0206251 | A1 | 10/2004 | Nix |
| 2004/0255552 | A1 | 12/2004 | Haberstroh et al. |
| 2005/0279198 | A1 | 12/2005 | Kushida et al. |
| 2006/0108180 | A1 | 5/2006 | Grach et al. |
| 2006/0192527 | A1 | 8/2006 | Kageler et al. |
| 2009/0013656 | A1 | 1/2009 | Nasiatka et al. |
| 2009/0114308 | A1 | 5/2009 | Nelson et al. |
| 2010/0107573 | A1 | 5/2010 | Neeser et al. |
| 2011/0056392 | A1 | 3/2011 | Neeser et al. |
| 2011/0100233 | A1 | 5/2011 | Neeser et al. |
| 2011/0253480 | A1 | 10/2011 | Goodman et al. |
| 2012/0017780 | A1 | 1/2012 | Haberstroh et al. |
| 2012/0160364 | A1 | 6/2012 | Katou et al. |
| 2012/0210682 | A1 | 8/2012 | Gardner et al. |

FOREIGN PATENT DOCUMENTS

| | | | |
|---|---|---|---|
| CN | 2209804 | Y | 10/1995 |
| CN | 2228453 | Y | 6/1996 |
| CN | 1151129 | A | 6/1997 |
| CN | 2266566 | Y | 11/1997 |
| CN | 1203878 | A | 1/1999 |
| CN | 1253099 | A | 5/2000 |
| CN | 1302244 | A | 7/2001 |
| CN | 2527302 | Y | 12/2002 |
| CN | 2542568 | Y | 4/2003 |
| CN | 1418163 | A | 5/2003 |
| CN | 1495098 | A | 5/2004 |
| CN | 1558842 | A | 12/2004 |
| CN | 1660675 | A | 8/2005 |
| CN | 2743232 | Y | 11/2005 |
| CN | 1274893 | C | 9/2006 |
| CN | 1859999 | A | 11/2006 |
| CN | 101092187 | A | 12/2007 |
| CN | 101134308 | A | 3/2008 |
| CN | 201030952 | Y | 3/2008 |
| CN | 101164416 | A | 4/2008 |
| CN | 101287578 | A | 10/2008 |
| CN | 100439207 | C | 12/2008 |
| CN | 100460284 | C | 2/2009 |
| CN | 101486329 | A | 7/2009 |
| CN | 101585244 | A | 11/2009 |
| CN | 201411058 | Y | 2/2010 |
| CN | 201411061 | Y | 2/2010 |
| CN | 101678903 | A | 3/2010 |
| CN | 201465919 | U | 5/2010 |
| CN | 101782361 | A | 7/2010 |
| CN | 101870367 | A | 10/2010 |
| CN | 102026873 | A | 4/2011 |
| CN | 102026874 | A | 4/2011 |
| CN | 102026875 | A | 4/2011 |
| CN | 202100012 | U | 1/2012 |
| DE | 3916355 | A1 | 12/1989 |
| DE | 4014305 | A1 | 11/1991 |
| DE | 4204420 | A1 | 8/1993 |
| DE | 19751861 | A1 | 1/1999 |
| DE | 10026200 | A1 | 11/2001 |
| DE | 20321137 | U1 | 1/2006 |
| DE | 102004012733 | B4 | 8/2006 |
| DE | 102005049130 | A1 | 4/2007 |
| DE | 102006007990 | A1 | 8/2007 |
| DE | 102009047443 | A1 | 6/2011 |
| DE | 202011050797 | U1 | 11/2011 |
| EP | 0095643 | A2 | 12/1983 |
| EP | 0480627 | A1 | 4/1992 |
| EP | 0603868 | A1 | 6/1994 |
| EP | 0659525 | A2 | 6/1995 |
| EP | 0744343 | A1 | 11/1996 |
| EP | 0838400 | A1 | 4/1998 |
| EP | 0949146 | A1 | 10/1999 |
| EP | 0997377 | A1 | 5/2000 |
| EP | 0999133 | A1 | 5/2000 |
| EP | 1177978 | A1 | 2/2002 |
| EP | 1316506 | A1 | 6/2003 |
| EP | 1413519 | A1 | 4/2004 |
| EP | 1824738 | A1 | 8/2007 |
| EP | 1837279 | A1 | 9/2007 |
| EP | 2271553 | A1 | 1/2011 |
| GB | 489050 | A | 7/1938 |
| GB | 1136845 | A | 12/1968 |
| GB | 1136846 | A | 12/1968 |
| GB | 1136847 | A | 12/1968 |
| GB | 1161827 | A | 8/1969 |
| GB | 2041869 | A | 9/1980 |
| GB | 2481724 | A | 1/2012 |
| JP | S5290398 | U | 7/1977 |
| JP | S541238 | B1 | 1/1979 |
| JP | S5638220 | A | 4/1981 |
| JP | 6322320 | A | 1/1988 |
| JP | 01213109 | A | 8/1989 |

(56) References Cited

FOREIGN PATENT DOCUMENTS

| | | | |
|---|---|---|---|
| JP | H05198241 | A | 8/1993 |
| JP | H0711508 | U | 2/1995 |
| JP | H07300108 | A | 11/1995 |
| JP | H08258808 | A | 10/1996 |
| JP | H08324506 | A | 12/1996 |
| JP | H09283103 | A | 10/1997 |
| JP | H10161832 | A | 6/1998 |
| JP | 3054566 | U | 12/1998 |
| JP | 3044132 | B2 | 5/2000 |
| JP | 2000128113 | A | 5/2000 |
| JP | 2000128115 | A | 5/2000 |
| JP | 3227693 | B2 | 9/2001 |
| JP | 3242081 | B2 | 10/2001 |
| JP | 2002235830 | A | 8/2002 |
| JP | 2003170906 | A | 6/2003 |
| JP | 2003231291 | A | 8/2003 |
| JP | 2003348899 | A | 12/2003 |
| JP | 3548622 | B2 | 4/2004 |
| JP | 2004108593 | A | 4/2004 |
| JP | 2004241150 | A | 8/2004 |
| JP | 2004323111 | A | 11/2004 |
| JP | 2007276042 | A | 10/2007 |
| JP | 4095817 | B2 | 3/2008 |
| JP | 4366208 | B2 | 8/2009 |
| JP | 4405220 | B2 | 11/2009 |
| JP | 4406016 | B2 | 11/2009 |
| JP | 4627598 | B2 | 11/2010 |
| JP | 4814577 | B2 | 9/2011 |
| KR | 840002211 | B1 | 12/1984 |
| KR | 20000029337 | A | 5/2000 |
| KR | 200286283 | Y1 | 8/2002 |
| RU | 1772784 | C | 10/1992 |
| RU | 2118277 | C1 | 8/1998 |
| RU | 2161773 | C2 | 1/2001 |
| RU | 2004115639 | A | 1/2006 |
| RU | 2355281 | C2 | 5/2009 |
| RU | 2355821 | C1 | 5/2009 |
| SU | 1134117 | A3 | 1/1985 |
| WO | 9627526 | A1 | 9/1996 |
| WO | 0189929 | A1 | 11/2001 |
| WO | 2004039676 | A1 | 5/2004 |
| WO | 2006048738 | A1 | 5/2006 |
| WO | 2007116914 | A1 | 10/2007 |
| WO | 2009129633 | A1 | 10/2009 |
| WO | 2009129636 | A1 | 10/2009 |

OTHER PUBLICATIONS

"International Search Report and Written Opinion", PCT/CH2009/000004 (15 pages), dated Apr. 6, 2009.
"International Search Report and Written Opinion", PCT/CH2009/000001 (18 pages), dated Jun. 22, 2009.
"International Search Report and Written Opinion", PCT/CH2009/000002 (18 pages), dated Jun. 22, 2009.
"International Search Report and Written Opinion", PCT/CH2009/000003 (16 pages), dated Jun. 22, 2009.
"International Search Report and Written Opinion", PCT/CH2009/000005 (14 pages), dated Jun. 22, 2009.
"Japanese Office Action", Application No. JP-2011-505337 (3 pages), dated Mar. 27, 2013.
"Japanese Office Action", Application No. JP-2011-505339 (4 pages), dated Mar. 27, 2013.
"Korean Office Action", Application No. 10-2010-7023734 (6 pages), dated Apr. 6, 2015.
"Korean Office Action", Application No. 10-2010-7023709 (7 pages), dated May 18, 2015.
"Korean Office Action", Application No. 10-2010-7023729 (8 pages), dated May 18, 2015.
"Korean Office Action", Application No. 10-2010-7023730 (6 pages), dated May 18, 2015.
"Korean Office Action", Application No. 10-2010-7023737 (7 pages), dated May 18, 2015.
"Russian Decision to Grant", Application No. 2010147639 (13 pages), dated Aug. 31, 2012.
"Russian Decision to Grant", Application No. 201047640 (10 pages), dated Sep. 6, 2012.
Bender, "Lithium Ion Technology: Shaping Power Tool", Air Conditioning, Heating, and Refrigeration News, vol. 228, Issue 14, p. 18 (3 pages), Jul. 31, 2006.
Emandi, Ali, "Brushless DC Motor Drives", Energy-Efficient Electrical Motors, 3rd ed., Para. 270-272, CRC Press & Marcel Dekker (3 pages).
Intellectual Property India, "Examination Report", Indian Application No. 6713/CHENP/2010 (7 pages), dated Jan. 15, 2018.
Orgapack GMBH, "OR-T 100, Battery-Hand Tool for Plastic Strapping", Operating and Safety Instructions (53 pages), Nov. 1, 2004.
Orgapack GMBH, "OR-T 200, Battery-Hand Tool for Plastic Strapping", Operating and Safety Instructions (53 pages), Feb. 1, 2004.
Orgapack GMBH, "OR-T 300, Battery-Hand Tool for Plastic Strapping", Operating and Safety Instructions (53 pages), Mar. 1, 2005.
Orgapack GMBH, "OR-T 50, Hand Tool for Plastic Strapping", Operating and Safety Instructions (53 pages), May 1, 2006.
Orgapack GMBH, "OR-T 83, Hand Tool for Plastic Strapping", Operating Instructions (58 pages), Aug. 1, 2000.
Orgapack GMBH, "OR-T 85, Hand Tool for Plastic Strapping", Operating Instructions (58 pages), Jun. 1, 2000.
Orgapack GMBH, "OR-T 86, Hand Tool for Plastic Strapping", Operating Instructions (58 pages), Aug. 1, 1999.
Orgapack GMBH, "OR-T 87, Hand Tool for Plastic Strapping", Operating and Safety Instructions (63 pages), May 1, 2002.

* cited by examiner

STRAPPING DEVICE

PRIORITY CLAIM

This application is a continuation of, and claims priority to and the benefit of, U.S. patent application Ser. No. 16/677,266, filed on Nov. 7, 2019, which is a continuation of, and claims priority to and the benefit of, U.S. patent application Ser. No. 14/918,167, filed on Oct. 20, 2015, which issued as U.S. Pat. No. 10,518,914 on Dec. 31, 2019, which is:

- a continuation of, and claims priority to and the benefit of, U.S. patent application Ser. No. 12/989,112, filed on Nov. 23, 2010, which issued as U.S. Pat. No. 9,174,752 on Nov. 3, 2015, which is a national stage entry of PCT/CH2009/000001, filed on Jan. 6, 2009, which claims priority to and the benefit of Swiss Patent Application No. 645/08, filed on Apr. 23, 2008, the entire contents of each of which are incorporated herein by reference;
- a continuation of, and claims priority to and the benefit of, U.S. patent application Ser. No. 12/989,142, filed on Nov. 23, 2010, which issued as U.S. Pat. No. 9,284,080 on Mar. 15, 2016, which is a national stage entry of PCT/CH2009/000002, filed on Jan. 6, 2009, which claims priority to and the benefit of Swiss Patent Application No. 646/08, filed on Apr. 23, 2008, the entire contents of each of which are incorporated herein by reference;
- a continuation of, and claims priority to and the benefit of, U.S. patent application Ser. No. 12/989,181, filed on Nov. 23, 2010, which issued as U.S. Pat. No. 9,315,283 on Apr. 19, 2016, which is a national stage entry of PCT/CH2009/000003, filed on Jan. 6, 2009, which claims priority to and the benefit of Swiss Patent Application No. 647/08, filed on Apr. 23, 2008, the entire contents of each of which are incorporated herein by reference;
- a continuation of, and claims priority to and the benefit of, U.S. patent application Ser. No. 12/989,281, filed on Nov. 23, 2010, which issued as U.S. Pat. No. 9,193,486 on Nov. 24, 2015, which is a national stage entry of PCT/CH2009/000004, filed on Jan. 6, 2009, which claims priority to and the benefit of Swiss Patent Application No. 648/08, filed on Apr. 23, 2008, the entire contents of each of which are incorporated herein by reference; and
- a continuation of, and claims priority to and the benefit of, U.S. patent application Ser. No. 12/989,355, filed on Nov. 23, 2010, which issued as U.S. Pat. No. 9,254,932 on Feb. 9, 2016, which is a national stage entry of PCT/CH2009/000005, filed on Jan. 6, 2009, which claims priority to and the benefit of Swiss Patent Application No. 649/08, filed on Apr. 23, 2008, the entire contents of each of which are incorporated herein by reference.

Certain embodiments of the invention relate to a mobile strapping device for strapping packaged goods with a wrap-around strap, comprising a tensioner for applying a strap tension to a loop of a wrapping strap, as well as a friction welder for producing a friction weld at two areas of the loop of wrapping strap disposed one on top of the other, and a chargeable energy storage means for storing energy that can be released as drive energy at least for the friction welder for producing a friction weld.

Such mobile strapping devices are used for strapping packaged goods with a plastic strap. For this a loop of the plastic strap is placed around the packaged goods. Generally the plastic strap is obtained from a storage roll. After the loop has been completely placed around the packaged goods, the end area of the strap overlaps a section of the strap loop. The strapping device is then applied at this dual-layer area of the strap, the strap clamped into the strapping device, a strap tension applied to the strap loop by the strapping device and a seal produced on the loop between the two strap layers by the friction welding. Here a friction shoe moving in an oscillating manner is pressed onto the area of two ends of the strap loop. The pressure and the heat produced by the movement briefly locally melt the strap which generally contains a plastic. This produces a durable connection between the two strap layers which can only be broken with a large amount of force. The loop is then separated from the storage roll. The packaged goods are thus strapped.

Strapping devices of this type are intended for mobile use, whereby the devices are taken by a user to the location of use and are not reliant on the provision of external supply energy. The energy required for the envisaged use of such strapping device to strap a wrapping strap around any packaged goods and to produce the seal, is general provided in previously known strapping device by an electrical storage battery or by compressed air. Strapping devices of this type are often in continuous use in industry for packaging goods. Therefore as simple operation of the strapping devices as possible is aimed for. In this way on the one hand a high level of functional reliability, associated with high-quality strapping, and on the other hand as little effort as possible for the operator should be assured Strapping devices have already become known in which production of the seal and production of the strap tension are largely automated. However, automation of the processes has the disadvantage that the strapping devices have a large number of components and generally also several motors. This results in heavy and voluminous strapping devices. Also, strapping devices provided with a large number of components tend to be top heavy in terms of their weight distribution. Automation also had disadvantages in terms of maintenance costs and the functional reliability of such strapping devices.

One aim of certain embodiments of the invention is therefore to create a mobile strapping device which in spite of the possibility of at least largely automated production of wrapped straps, exhibits a high level of functional reliability and good handling properties.

In accordance with certain embodiments of the invention this objective is achieved with a mobile strapping device by means of a planetary gear system for transferring and changing the rotational speed of a drive movement provided by an electrical drive of the friction welder. In accordance with certain embodiments of the invention the strapping device has at least one planetary gear system which is arranged in the drive train of the friction welder. It has been shown planetary gear in combination with an electrical drive motor provide particularly advantages in friction welders. For example, with planetary gears, in spite of high initial speeds and compact design, high torques can be produced.

This can also be advantageously used for the particularly functionally reliable, possibly automated transfer movement of the friction welder from a rest position into a welding position, in which the friction welder is in contact with the strap to be welded and produces a friction weld by way of an oscillating motion. This can be of particular advantage if, as is the case in certain embodiments of the invention, both the actual friction welding movement of a friction welding element as well as the transfer movement can be generated by the same drive. Such an embodiment with only one drive for these functions is, despite the high degree of automation, particularly compact, and, with its weight being advantageously distributed, nevertheless functionally reliable.

These advantages can be improved further by way of certain embodiments of the invention in which the same drive, designed to bring about the oscillating friction welding motion, also generators the tensioning movement of the strapping device. In order to be able to make the strapping device as compact as possible despite the high torque, a planetary gear system can also be arranged in the drive train of the strapping device.

In accordance with another embodiment of the present invention, which is also of independent relevance, the strapping device is provided with a brushless direct current motor. More particularly, this motor can be envisaged as the sole motor in the strapping device. Unlike in the case of brush-based direct current motors, such a motor can over a broad speed range produce a rotational movement with an essentially constant and comparatively high torque. Such a high torque is advantageous more particularly for motor-driven transfer movements of the friction welder from a rest position into a welding position and possibly back again. If high torques can be provided by the strapping device, it is possible to make the start of the transfer movement dependent on overcoming high forces. This increases the reliability, more particularly the functional reliability, as the fiction welder cannot be accidentally moved from its envisaged position by external influences.

By using a brushless direct current motor as the drive for the tensioner, further advantages can be achieved, as in this way it is possible to control the rotational speed of the tensioning procedure. For example, in contrast to hitherto possible torques, even a low speeds this allows a comparatively high tensioning device torque. Thus, with such mobile strapping device it is for the first time possible to place a strap around packaged goods at low speed but towards the end of the tensioning procedure. In previous tensioners, in order to achieve sufficient strap tensioning, the strap had to be moved at high speed at the start of the tensioning procedure, so that the required strap tension can be achieved towards the end of the tensioning procedure. In doing so the strap is whipped against the packaged goods which involves a high risk of damaging the packaged goods. Even sensitive packaged goods can thus be strapped all-round with considerably less danger of damage.

Furthermore, a speed-dependent/speed-controlled tensioning procedure also allows rapid initial tensioning, i.e. tensioning at high strap retraction speed, followed by second tensioning procedure with a reduced strap retraction speed compared with the first tensioning procedure. In such brushless motors, due to the possibility of setting the rotational speed of the motor shaft and the motor torque separately within certain ranges, the strap retraction speeds can be adjusted to the required/desired circumstances during both tensioning procedures. Particularly high strap tensions can be achieved with the described division into a first and at least a second tensioning procedure.

In accordance with another embodiment of the present invention, which may also be independently relevant, the strapping device is provided with means with which the rotation position of the motor shaft or the positions of components of the strapping device dependent on the motor shaft can be determined. The information about one or more rotational positions can preferably be used by a strapping device controller to control components of the strapping device, such as the friction welder and/or the tensioner. If a brushless direct current motor is used as the device, this can be done in a particularly simple way. For their commutation such motors must already determine information about momentary positions of the rotating component of the motor, which is generally designed as rotating anchor. For this, detectors/sensors, such as Hall sensors, are provided on the motor which determine the rotational positions of the rotating motor components and make them available to the motor control unit. This information can also advantageously be used to control the friction welder.

Thus, in one embodiment of the strapping device it can be envisaged that a number of rotations of the rotating components of the motor are determined in order, on reaching a given value or rotations, to carry out a switching operation. More particularly, this switching operation can involve switching off the friction welder to terminate the production of a friction weld connection. In a further advantageous embodiment of the invention it can be envisaged that at one or at several determined rotational positions the motor is not switched off, or is only switched off at one or more determined rotation positions.

It has proven to be advantageous if a device with a toggle lever system is provided to move the welding device from the rest position into the welding position and back. The levers of the toggle lever joint, which are connected to each other via one joint, can, by overcoming two dead point positions, be brought into both end positions at which they hold the welding device in the rest position or in the welding position. Advantageously the toggle lever device is held in both end positions by a force, preferably a force exerted by a mechanical spring. Only by overcoming this force should the toggle lever device be able to move from one end position into the other. The toggle lever device achieves the advantage that end positions of the welding device are only changed by overcoming comparatively high torques. As this applies especially to the welding position, the toggle lever system contributes to further increasing the functional reliability of the strapping device. Furthermore, the toggle lever system advantageously supplements the drive train of the strapping device, which in one form of embodiment of the invention also has a brushless motor and a planetary gear system in addition to the toggle lever system, for automated movement of the welding device into its welding position, as all the components are able to produce high torques or carry out movements when high torques are applied.

Certain embodiments of the invention relate to a mobile strapping device for strapping packaged goods with a wrap-around strap, comprising a tensioner for applying a strap tension to a loop of a wrapping strap, as well as a friction welder for producing a friction weld connection at two areas of the loop of wrapping strap disposed one on top of the other, and a chargeable energy storage means for storing energy, more particularly electrical, elastic or potential energy, that can be released as drive energy at least for the friction welder for producing a friction weld connection.

Such strapping devices have a tensioner, with which sufficiently great strap tension can be applied to a loop of strapping placed around the packaged goods. By means of preferably one clamping device of the strapping device the strap loop can then affixed to the packaged good for the following connection procedure. In strapping device of this type the connection procedure takes place by way of a friction welder. The pressure and the heat produced by the movement briefly locally melt the strap which generally contains a plastic. This produces a durable connection between the two strap layers which can only be broken with a large amount of force.

Strapping devices of this type are envisaged for mobile use, whereby the devices are taken by a user to the deployment site and should not be reliant on the use of externally supplied energy. In previously known strapping devices the energy required for the intended use of such strapping devices for strapping a wrapping strap around any type of packed goods and for producing the connection, is generally provided by an electrical storage battery or by compressed air. With this energy the strap tension applied to the strap by the tensioner and the connection on the strap are produced. Strapping devices of this type are also designed to connect only weldable plastic straps to each other.

In mobile devices a low weight is of particular importance in order to put as little physical strain on the user of the strapping device as possible when using the device. Also, for ergonomic reasons the weight of the strapping device should be distributed as evenly as possible, in order to avoid concentration of the weight in the head area of the strapping device. Such concentration results in unfavorable handling properties of the device. As ergonomic and user-friendly handling of the strapping device as possible are always striven for. More particularly the possibility of incorrect use or faulty operation should be minimal.

One aim of certain embodiments of the invention is therefore to improve the handling and operating properties of a strapping device.

In accordance with certain embodiments of the invention this objective is achieved in a mobile strapping device of this type by a means of a common drive for the tensioner for producing a tensioning movement as well as for the friction welder for producing an oscillating friction welding movement and for a transitioning device for bringing about a transfer movement of the friction welder from a rest position into a welding position.

In accordance with certain embodiments of the invention a mobile strapping device is provided with a motor-driven tensioner and friction welder. In order to be able to use such as strapping device at least approximately as a hand-held strapping device, it also has a motor-drive transitioning device for the friction welder. In terms of the weight, and in order to avoid a concentration of the weight in the head area of the device, in spite of the high degree of automation of the strapping device in accordance with certain embodiments of the invention, all these functional units of the strapping device are driven by just one common drive.

Preferably this just one drive can be designed as an electric motor, the drive movement of which can be used to consecutively drive the tensioner and the friction welder. In an expedient embodiment of the invention means are provided with which a functional connection can be produced either between the just one drive and the tensioner, or between the drive and the friction welder, for example reversing the rotational direction of the motor shaft of the drive.

Preferably with this just one motor not only is the drive movement of the welding procedure itself produced, but also a movement of the friction welder from a rest position into a welding position. In the welding position a welding element of the friction welder is pressed onto the strap layers to be welded to each other and through an oscillating movement produces a friction weld on the strap layers. Here, the welding element is preferably inactive in the rest position and is only started up at the beginning of the movement from the rest position.

The drive of the portable strapping device can preferably be a single electric motor. It has been shown that the motor can advantageously be a brushless direct current motor. Such a motor can be operated in such a way that at different rotational speeds it produces an essentially constant torque.

By using a brushless direct current motor as the drive for the tensioner further advantages can be achieved, as in this way it is possible to control the tensioning procedure in dependence on the rotational speed. For example, in contrast to hitherto possible torques, even a low speeds this allows a comparatively high tensioning device torque. Thus, with such mobile strapping devices it is for the first time possible to place a strap around packaged goods at low speed but towards the end of the tensioning procedure. In previous tensioners, in order to achieve sufficient strap tensioning, the strap had to be moved at high speed at the start of the tensioning procedure, so that the required strap tension can be achieved towards the end of the tensioning procedure. In doing so the strap is whipped against the packaged goods which involves a high risk of damaging the packaged goods. Even sensitive packaged goods can thus be strapped with considerably less danger of damage.

Furthermore, a speed-dependent/speed-controlled tensioning procedure also allows rapid initial tensioning, i.e. tensioning at high strap retraction speed, followed by second tensioning procedure with a reduced strap retraction speed compared with the first tensioning procedure. In such brushless motors, due to the possibility of setting the rotational speed of the motor shaft and the motor torque separately within certain ranges, the strap retraction speeds can be adjusted to the required/desired circumstances during both tensioning procedures. Particularly high strap tensions can be achieved with the described division into a first and at least a second tensioning procedure.

Advantageously at least one planetary gear system is arranged in the force flow between the common drive for the friction welder and for the tensioning device. With regard to the weight of the strapping device and its weight distribution this makes it possible to produce the generally considerably different rotational speeds for the tensioner and the friction welder.

The degree of automation of the strapping device in accordance with certain embodiments of the invention can advantageously be improved with as small a number of required components as possible, in that the coordination between the transmission device and friction welder takes place by means of the same single drive. It can be envisaged that the drive motion of the motor is used both as the drive source for the automatic transmission device as well as to achieve the at least approximately synchronous start of the oscillating movement of the friction welder and the transfer movement of the transitioning device. For this a gearing device can be envisaged which transforms the motorized drive movement into different step-down or step-up gear ratios and releases these at two different points, preferably simultaneously, namely at one point for the friction welder and at another point for the transitioning device.

The common gear system device of the friction welder and its transitioning device can advantageously be arranged on a free wheel, which in a certain rotational direction of a drive shaft of the motor transmits the drive movement to the gear system device. Preferably this rotational direction is different from the rotational direction with which the tensioner is operated. It has proven to be beneficial if, seen in the direction of transmission of the drive movement, splitting of the drive movement on the one hand in the direction of the friction welding element of the friction welder, and on the other hand to transitioning device, only takes place after the free wheel. The gear system device can have a first gear section for the friction welder and a second gear section for the transitioning device, whereby both gear sections perform different step-down or step-ups of the drive movement.

It has proven to be particularly advantageous, if in the drive train of the transitioning device, as a component of the gear system device a gear is provided with which a step down ratio in a range of 100:1 to 30:1, preferably 40:1 to 80:1 and particularly preferably 50:1 to 70:1 can be achieved. Such a step-down ratio can be advantageously attained with a planetary gear, more particularly a multiple stage planetary gear. However other types of gear can also be provided, such as bevel gears.

An expedient form of one embodiment of the invention provided with a planetary gear system can be cam controlled, whereby a rotating cam is used for switching the device on and off. It can be envisaged that through mechanical operation the cam brings about a movement of the friction welder from a rest position into a welding position.

An embodiment of the strapping device can also be of independent relevance in which an operating means for the joint operation of the tensioner and the friction welder is provided, by means of which the tensioner and friction welder can be consecutively started up. Here it is preferable if in the strapping device optionally either the tensioner or the friction welder are activated by just one operation of the operating means in order to consecutively perform their functions, or tensioner and friction welder can be operated separately of each other. In joint activation, through a common activation manipulation, for example by pressing just one switch, the tensioner is initially started and after completion of the tensioning procedure, without further manual operation of the device, the welding procedure is automatically started and carried out. On the other hand, in the case of separate operation the user can determine the times at which the tensioner is operated and at which time intervals separate operation of the friction welder is started independently of the tensioner. For this, separate operation of an operating element is envisaged, which then also allows at least largely automated welding procedure to take place.

In a possible further development of the invention an adjustable and operating switch means for both of these modes can be envisaged, with which the operating means are provided with the joint activation function but also with the possibility of independent and separate operation the tensioner and friction welder.

Certain embodiments of the invention relate to a mobile strapping device for strapping packaged goods with a wrap-around strap, comprising a tensioner for applying a strap tension to a loop of a wrapping strap, as well as a connector for producing a connection at two areas of the loop of wrapping strap disposed one on top of the other, and a chargeable energy storage means for storing energy that can be released as drive energy at least for the connector and/or tensioner.

Such mobile strapping devices are used for strapping packaged goods with a plastic strap. For this a loop of the plastic strap is placed around the packaged goods. Generally the plastic strap is obtained from a storage roll. After the loop has been completely placed around the packaged goods, the end area of the strap overlaps a section of the strap loop. The strapping device is then applied at this dual-layer area of the strap, the strap clamped into the strapping device, a strap tension applied to the strap loop by the strapping device and a seal produced on the loop between the two strap layers by the connector. For this various connecting technologies are possible, including friction welding. In the case of the latter, a friction shoe moving in an oscillating manner is pressed onto the area of two ends of the strap loop. The pressure and the heat produced by the movement briefly locally melt the strap which generally contains a plastic. This produces a durable connection between the two strap layers which can only be broken with a large amount of force. The loop is then separated from the storage roll. The packaged goods are thus strapped.

For their energy supply strapping devices of this type generally have a chargeable and possibly interchangeable storage battery with which direct current motors are supplied with electrical energy. In the portable mobile strapping devices the direct current motors envisaged for producing drive movements of the tensioner and/or welding device.

Strapping devices of this type are often in continuous use in industry for packaging goods. Therefore as simple operation of the strapping devices as possible is aimed for. In this way on the one hand a high level of functional reliability, associated with high-quality strapping, and on the other hand as little effort as possible for the operator should be assured. Previously known strapping device cannot fully satisfy these requirements.

One aim of certain embodiments of the invention is therefore to create a mobile strapping device which in spite of the possibility of at least largely automated production of wrapped straps, exhibits a high level of functional reliability and good handling properties.

In accordance with certain embodiments of the invention this objective is achieved with a mobile strapping device in that the energy storage means has a lithium-ion storage battery which provides energy to drive a connector designed in the form of a friction welder. It has been shown that particularly good functional reliability can be achieved with such storage batteries as these storage batteries provide sufficient energy to carry out a large number of strapping cycles with mobile strapping device, even if strap tensions are applied and at least largely automated strapping procedures with motorized drive movements are be carried out.

In order to weld PP or PET straps, welding shoe frequencies of approximately 250-350 Hz with a pressing pressure of 300-350 N are required. In order to achieve these values a drive-side rotational speed of an eccentric tappet driving the welding shoe of approximately 6000 rpm to 7000 rpm is necessary. Ideally with these initial values a welding procedure takes place over a duration of 1.5 seconds to 2 seconds. If the eccentric shaft speed falls below the value of 6000 rpm, the band seal quality deteriorates considerably.

Within the framework of the invention it has been shown that the prematurely deteriorating connection quality observed in conventional manual strapping device, even though the storage batteries are not even 60% discharged, does not occur in his manner with lithium ion storage batteries.

Lithium ion storage batteries can provide the voltage require for a high speed for considerably longer. In this way, compared with other storage batteries of similar size, lithium ion storage batteries provide the desired reliability for considerably longer i.e. in the case of a much higher of strapping procedure and friction weld. Only shortly before full consumption of the storage energy does the supply voltage provided by lithium ion storage batteries fall to values at which friction welding should not be carried out. As the time at which the user is requested to charge the storage battery shortly before full discharge by a corresponding signal on the strapping device corresponds with the time at which the storage battery no longer produces good quality friction weld, in contrast to conventional storage batteries the recharging signal can be seen by the user as an indication that as of then the required quality of subsequent strappings is no longer given.

As lithium ion storage batteries have a much higher energy density than conventional storage batteries, these advantages can even be achieved in relation to the dimensions of smaller storage batteries. The resulting reduced weight of the used storage batteries is a further significant advantage for use in mobile portable strapping devices.

Particular advantages can be achieved with lithium ion storage batteries in conjunction with at least one brushless direct current motor as the drive for the tensioner and/or friction welder. This can be further increased by means of a planetary gear system, particularly if the planetary gear system together with the brushless direct current motor and the lithium ion storage batteries are arranged in the drive train for the tensioner and/or friction welder.

Furthermore, a speed-dependent/speed-controlled tensioning procedure also allows rapid initial tensioning, i.e. tensioning at high strap retraction speed, followed by second tensioning procedure with a reduced strap retraction speed compared with the first tensioning procedure. In such brushless motors, due to the possibility of setting the rotational speed of the motor shaft and the motor torque separately within certain ranges, the strap retraction speeds can be adjusted to the required/desired circumstances during both tensioning procedures. Particularly high strap tensions can be achieved with the described division into a first and at least a second tensioning procedure.

An embodiment of strapping device can also be of independent relevance in which the tensioner and the welding device are only provided with one common drive. This just one drive can preferably be designed as an electric motor, with the drive movement of which the tensioner and the friction welder can be consecutively driven. Preferably, with this just one motor, not only is the drive movement of the welding procedure itself produced, but also a movement of the friction welder from a rest position into a welding position in which a welding element of the friction weld is pressed onto the layers of strap to be welded and a friction weld is produce through an oscillating movement on the strap layers. Here, the welding element of the friction welder is in active in the rest position and is preferably only started up at the start of movement from the rest position.

In accordance with another embodiment of the present invention, which may also be of independent relevance, the strapping device is provided with means with which the rotational position of the motor shaft or the position of components of the strapping device dependent on the motor shaft can be determined. The information about one or more rotational positions can preferably be used by a control device of the strapping device to control components of the strapping device, such as the friction welder and/or the tensioner. If a brushless direct current motor is used as the drive, this can be done in a particularly simple manner. For their commutation, such motors must determine current positions of the rotating component of the motor, which is generally a rotating anchor. For this, detectors/sensor, such as Hall sensors, are provided, which determine rotational positions of the rotating motor components and make them available to the motor control device. This information can also be used to advantage for control the friction welder.

Thus, in one embodiment of the strapping device it can be envisaged that a number of rotations of the rotating components of the motor are determined in order, on reaching a given value or rotations, to carry out a switching operation. More particularly, this switching operation can involve switching off the friction welder to terminate the production of a friction weld connection. In a further advantageous embodiment of the invention it can be envisaged that at one or at several determined rotational positions the motor is not switched off, or is only switched off at one or more determined rotation positions.

It has proven to be advantageous if a device with a toggle lever system is provided to move the welding device from the rest position into the welding position and back. The levers of the toggle lever joint, which are connected to each other via one joint, can, by overcoming two dead point positions, be brought into both end positions at which they hold the welding device in the rest position or in the welding position. Advantageously the toggle lever device is held in both end positions by a force, preferably a force exerted by a mechanical spring. Only by overcoming this force should the toggle lever device be able to move from one end position into the other. The toggle lever device achieves the advantage that end positions of the welding device are only changed by overcoming comparatively high torques. As this applies especially to the welding position, the toggle lever system contributes to further increasing the functional reliability of the strapping device. Furthermore, the toggle lever system advantageously supplements the drive train of the strapping device, which in one form of embodiment of the invention also has a brushless motor and a planetary gear system in addition to the toggle lever system, for automated movement of the welding device into its welding position, as all the components are able to produce high torques or carry out movements when high torques are applied.

Certain embodiments of the invention relate to a strapping device, more particularly a mobile strapping device, for strapping packaged goods with a wrapping strap, comprising a tensioner for applying a strap tension to a loop of a wrapping strap, a rotationally drivable tensioning wheel as well as tensioning rocker that can be pivoted relative to the tensioning wheel and acts together with the tensioning wheel, whereby a tensioning plate is arranged on the tensioning rocker for applying a wrapping strap and a distance between the tensioning plate and the tensioning wheel can be changed in order to apply a tension force to the strap, and a connector, more particularly a welding device, such as a friction welder, for producing a connection at two areas of the loop of wrapping strap disposed one on top of the other.

In strapping devices of this type a rotationally drivable tensioning wheel works in conjunction with a toothed and generally concavely curved tensioning plate which is arranged on a pivotable rocker. In order to apply a tension force to a strap loop the rocker can be pivoted in the direction of the tensioning wheel and pressed against the tensioning wheel. As a rule a pivoting axis of the rocker does not correspond with the rotational axis of the tensioning wheel. This allows the rocker to be "opened" and "closed" with regard to the tensioning wheel, whereby the strap to be tensioned can be placed in the strapping device, held and tensioned by the tensioner and then removed again. In the area between the tensioning wheel and the tensioning plate the strap loop is in two layers. The lower layer is grasped by the tensioning plate of the rocked pivoted towards the tensioning wheel, and through its surface structure or other suitable means for producing friction, held on the tensioning plate by the pressure exerted by the tensioning plate on the lower strap layer. In this way it is possible to grasp and retract the upper layer with the rotationally driven tensioning wheel. In the strap loop this brings about or increases the strap tension and straps the loop tightly around the packaged goods.

Such strapping devices are mainly used in conjunction with plastic straps, loops of which are connected by means of a friction weld. The strapping device therefore has a friction welder with which the strap loops in the area of the two layers of strap one on top of the other can be heated in the strapping device by means of an oscillating friction welding element until the plastic strap melts locally, the materials of the two strap layers flow into each other and are firmly connected on cooling.

It has been shown that in such strapping devices the applied strap tension can vary considerably, particularly in the case of various strap thicknesses. One aim of certain embodiments of the invention is therefore to create a strapping device with which even with different strap thicknesses, as equally good tension properties as possible can be achieved.

This is achieved in the strapping device in that the tensioning plate is movably arranged on the tensioning rocker.

Within the framework of the invention it was seen that the fluctuating strap tension in the case of different strap widths is due to the fact that the position of the tensioning plate changes in relation to the tensioning wheel. In this way, depending on the strap thicknesses involved, different engaging and pressing conditions occur between the two strap layers on the one hand, and the tensioning plate and tensioning wheel on the other hand. The invention therefore envisages means of compensating for the displacement of the engaging points. This at least one means can involve a relative mobility of the tensioning plate with regard to the tensioning rocker, more particularly floating bearing of the tensioning plate on the tensioning rocker. Alternatively, or in addition thereto, a change in the position of the tensioning wheel in relation to the pivoting axis of the rocker can be envisaged.

The preferably envisaged relative mobility of the tensioning plate with regard to the tensioning rocker should, in particular, be present in a direction in which a position of the tensioning plate can be changed with regard to the circumference of the tensioning wheel. This direction corresponds at least approximately to the longitudinal direction along which a wrapping strap placed in the strapping device extends within the strapping device, or the direction along which the tensioning plate moved as a result of the rocker movement. Such an embodiment has the advantage that the pressing pressure, more particularly an essentially evenly distributed pressing pressure is made possible by the tensioning plate on the strap and/or the strap on the tensioning wheel, irrespective of the strap thickness, essentially over the entire length of the tensioning plate.

Alternatively, or in addition to the mobility of the tensioning plate, the engaging conditions can be further improved, even for different strap thicknesses, in that the tensioning plate is concavely curved in one radius, which advantageously approximately corresponds with or can be slightly larger than the outer radius of the tensioning wheel. During the tensioning procedure such a concave design of the tensioning surface contributes to providing a gap with an approximately constant gap height between the tensioning surface of the tensioning plate and the external surface of the tensioning wheel over preferably the entire length of the tensioning surface—in relation to the tensioning direction.

In contrast to the solution in accordance with certain embodiments of the invention, in the previous solution a distribution of the pressing pressure on a surface section of the wrapping strap was essentially only possible at a certain strap thickness, through which the rocker took up a position at which the curvature of the tensioning plate runs parallel to the circumference of the tensioning radius. The gap between the tensioning wheel and the tensioning plate therefore only had a constant gap height over the entire length of the tensioning plate at a certain strap thickness. The more the strap thickness differed from a strap thickness fitting this gap, the smaller surface of the upper and lower strap layer, on which the tensioning plate/tensioning wheel could act. With the embodiment in accordance with certain embodiments of the invention it is now possible to compensate for the different pivoting positions of the rocker in relation to the tensioning wheel due to the different strap thicknesses in such a way that despite the different positions of the tensioning rocker, the tensioning plate can always be essentially arranged so that over the entire length of the tensioning plate there is a gap with an essentially constant gap height over the entire, or at least with less gap height variation than in previous solution. Over the entire length of the tensioning plate this allows more even pressure application on the wrapping strap than hitherto.

The solution according to the invention exhibits advantages to a particular extent in the case of small packaged goods (edge length approximately 750 mm and less) as well as round packaged goods (diameter approximately 500-1000 mm) in connection with high tensile forces. In these conditions the then comparatively small strap loop had resulted in shock-like stressing of the lower strap layer, i.e. the strap end, through which the lower strap layer is pulled against the tensioning plate. Due to very different pressing conditions over the entire length of the tensioning plate, securing holding of the strap end in the strapping device could not guaranteed in previous solutions. The movable tensioning plate exhibits decisive advantages here, which are essentially seen in the fact that even at shock-like tensile stresses in connection with high tensile forces, the straps can be held by the toothed plate, which is optimally arranged because of its mobility.

In one embodiment of the invention, the relative mobility of the tensioning plate can be realized by arranging the tensioning plate on the rocker using bearing surfaces of the tensioning plate that are not parallel to each other. On the basis of this principle the tensioning plate can be provided with a convex contact surface which rests on an essentially level contact surface of the rocker. This allows pivoting of the tensioning plate, whereby self-alignment and clinging of the tensioning plate to the circumference of the tensioning wheel can take place. In one embodiment measures can be envisaged through which self-alignment of the tensioning plate in a direction perpendicular to the direction of the strap can be achieved. Such a measure can for example be a convex shaping of the bearing surface of the tensioning plate perpendicularly to the direction of the strap.

A further advantageous embodiment of the invention can also envisage the tensioning plate being provided with a guide, through which a movement in one or several predetermined directions takes place. The guide direction can in particular be a direction which is essentially parallel to the direction of the strap within the strapping device. In an expedient embodiment, the guide for the tensioning plate can also be produced by an elongated hold and a guide means, such as a screw, arranged therein.

Certain embodiments of the invention relate to a mobile strapping device for strapping packaged goods with a wrap-around strap, comprising a tensioner for applying a strap tension to a loop of a wrapping strap, as well as a connector for producing a connection at two areas of the loop of wrapping strap disposed one on top of the other, and a chargeable energy storage means for storing energy that can be released as drive energy at least for the connector and/or tensioner.

Such mobile strapping devices are used for strapping packaged goods with a plastic strap. For this a loop of the plastic strap is placed around the packaged goods. Generally the plastic strap is obtained from a storage roll. After the loop has been completely placed around the packaged goods, the end area of the strap overlaps a section of the strap loop. The strapping device is then applied at this dual-layer area of the strap, the strap clamped into the strapping device, a strap tension applied to the strap loop by the strapping device and a seal produced on the loop between the two strap layers by the connector. For this various connecting technologies are possible, including friction welding. In the case of the latter, a friction shoe moving in an oscillating manner is pressed onto the area of two ends of the strap loop. The pressure and the heat produced by the movement briefly locally melt the strap which generally contains a plastic. This produces a durable connection between the two strap layers which can only be broken with a large amount of force. The loop is then separated from the storage roll. The packaged goods are thus strapped.

Such mobile strapping devices are used for strapping packaged goods with a plastic strap. For this a loop of the plastic strap is placed around the packaged goods. Generally the plastic strap is obtained from a storage roll. After the loop has been completely placed around the packaged goods, the end area of the strap overlaps a section of the strap loop. The strapping device is then applied at this dual-layer area of the strap, the strap clamped into the strapping device, a strap tension applied to the strap loop by the strapping device and a seal produced on the loop between the two strap layers by the connector. For this various connecting technologies are possible, including friction welding. In the case of the latter, a friction shoe moving in an oscillating manner is pressed onto the area of two ends of the strap loop. The pressure and the heat produced by the movement briefly locally melt the strap which generally contains a plastic. This produces a durable connection between the two strap layers which can only be broken with a large amount of force. The loop is then separated from the storage roll. The packaged goods are thus strapped.

Strapping devices of this type are often in continuous use in industry for packaging goods. Therefore as simple operation of the strapping devices as possible is aimed for. In this way on the one hand a high level of functional reliability, associated with high-quality strapping, and on the other hand as little effort as possible for the operator should be assured. Previously known strapping device cannot fully satisfy these requirements.

One aim of certain embodiments of the invention is therefore to create a mobile strapping device which in spite of the possibility of at least largely automated production of wrapped straps, exhibits a high level of functional reliability and good handling properties.

In accordance with certain embodiments of the invention this objective is achieved with a mobile strapping device by means of a brushless direct current motor as the drive for the tensioner and/or connector. As will be explained in more detail below, brushless direct current motors have electrical and mechanical properties which result in particular advantages in conjunction with mobile strapping devices. In addition, such motors are largely wear and maintenance-free, which contributes to a high level of functional reliability of the strapping devices.

Furthermore, a speed-dependent/speed-controlled tensioning procedure also allows rapid initial tensioning, i.e. tensioning at high strap retraction speed, followed by a second tensioning procedure with a reduced strap retraction speed compared with the first tensioning procedure. In such brushless motors, due to the possibility of setting the rotational speed of the motor shaft and the motor torque separately within certain ranges, the strap retraction speeds can be adjusted to the required/desired circumstances during both tensioning procedures. Particularly high strap tensions can be achieved with the described division into a first and at least a second tensioning procedure.

A strapping device in accordance with certain embodiments of the invention can also have energy storage means in the form of a lithium ion storage battery, with which energy can be provided to drive a connector in the form of a friction welder. It has been shown that with such storage batteries particularly good functional reliability can also be achieved as these storage batteries provide sufficient energy to carry out a large number of strapping cycles with mobile strapping devices, even if high strap tensions are applied and at least largely automated strapping procedures with motorized drive movements take place.

It has also been shown that lithium ion storage batteries in combination with friction welders can be seen as the ideal addition compared with other electrical energy storage means. The friction welding process itself is dependent on the pressure of the two straps on each other as well as the frequency of the oscillating welding shoe/welding element. In order to weld PP or PET straps, welding shoe frequencies of approximately 250-350 Hz with a pressing pressure of 300-350 N are required. In order to achieve these values a drive-side rotational speed of an eccentric tappet driving the welding shoe of approximately 6000 rpm to 7000 rpm is necessary. Ideally with these initial values a welding procedure takes place over a duration of 1.5 seconds to 2 seconds. If the eccentric shaft speed falls below the value of 6000 rpm, the band seal quality deteriorates considerably.

Within the framework of the invention it has been shown that the prematurely deteriorating connection quality observed in conventional manual strapping device, even though the storage batteries are not even 60% discharged, does not occur in his manner with lithium ion storage batteries. Lithium ion storage batteries can provide the voltage require for a high speed for considerably longer. In this way, compared with other storage batteries of similar size, lithium ion storage batteries provide the desired reliability for considerably longer i.e. in the case of a much higher of strapping procedure and friction weld. Only shortly before full consumption of the storage energy does the supply voltage provided by lithium ion storage batteries fall to values at which friction welding should not be carried out. As the time at which the user is requested to charge the storage battery shortly before full discharge by a corresponding signal on the strapping device corresponds with the time at which the storage battery no longer produces good quality friction weld, in contrast to conventional storage batteries the recharging signal can be seen by the user as an indication that as of then the required quality of subsequent strappings is no longer given.

As lithium ion storage batteries have a much higher energy density than conventional storage batteries, these advantages can even be achieved in relation to the dimensions of smaller storage batteries. The resulting reduced weight of the used storage batteries is a further significant advantage for use in mobile portable strapping devices.

Particular advantages can be achieved with lithium ion storage batteries in conjunction with at least one brushless direct current motor as the drive for the tensioner and/or friction welder. This can be further increased by means of a planetary gear system, particularly if the planetary gear system together with the brushless direct current motor and the lithium ion storage batteries are arranged in the drive train for the tensioner and/or friction welder.

An embodiment of strapping device can also be of independent relevance in which the tensioner and the welding device are only provided with one common drive. This just one drive can preferably be designed as an electric motor, with the drive movement of which the tensioner and the friction welder can be consecutively driven. Preferably, with this just one motor, not only is the drive movement of the welding procedure itself produced, but also a movement of the friction welder from a rest position into a welding position in which a welding element of the friction weld is pressed onto the layers of strap to be welded and a friction weld is produce through an oscillating movement on the strap layers. Here, the welding element of the friction welder is in active in the rest position and is preferably only started up at the start of movement from the rest position.

In accordance with another embodiment of the present invention, which may also be of independent relevance, the strapping device is provided with means with which the rotational position of the motor shaft or the position of components of the strapping device dependent on the motor shaft can be determined. The information about one or more rotational positions can preferably be used by a control device of the strapping device to control components of the strapping device, such as the friction welder and/or the tensioner. If a brushless direct current motor is used as the drive, this can be done in a particularly simple manner. For their commutation, such motors must determine current positions of the rotating component of the motor, which is generally a rotating anchor. For this, detectors/sensor, such as Hall sensors, are provided, which determine rotational positions of the rotating motor components and make them available to the motor control device. This information can also be used to advantage for control the friction welder.

Thus, in one embodiment of the strapping device it can be envisaged that a number of rotations of the rotating components of the motor are determined in order, on reaching a given value or rotations, to carry out a switching operation. More particularly, this switching operation can involve switching off the friction welder to terminate the production of a friction weld connection. In a further advantageous embodiment of the invention it can be envisaged that at one or at several determined rotational positions the motor is not switched off, or is only switched off at one or more determined rotation positions.

It has proven to be advantageous if a device with a toggle lever system is provided to move the welding device from the rest position into the welding position and back. The levers of the toggle lever joint, which are connected to each other via one joint, can, by overcoming two dead point positions, be brought into both end positions at which they hold the welding device in the rest position or in the welding position. Advantageously the toggle lever device is held in both end positions by a force, preferably a force exerted by a mechanical spring. Only by overcoming this force should the toggle lever device be able to move from one end position into the other. The toggle lever device achieves the advantage that end positions of the welding device are only changed by overcoming comparatively high torques. As this applies especially to the welding position, the toggle lever system contributes to further increasing the functional reliability of the strapping device. Furthermore, the toggle lever system advantageously supplements the drive train of the strapping device, which in one form of embodiment of the invention also has a brushless motor and a planetary gear system in addition to the toggle lever system, for automated movement of the welding device into its welding position, as all the components are able to produce high torques or carry out movements when high torques are applied.

Further preferred embodiments of the invention are set out in the claims, the description and the drawing.

The invention will be described in more detail by way of the examples of embodiment which are shown purely schematically.

Figure 1:
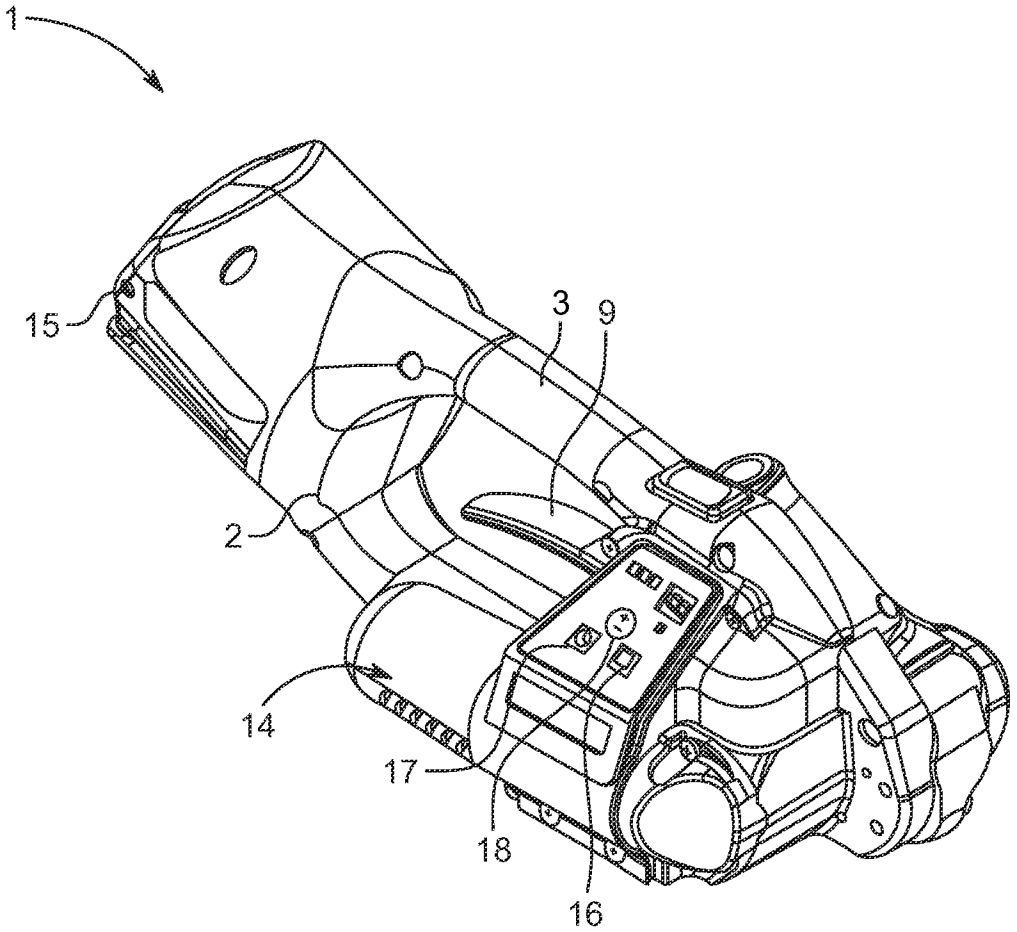
FIG. 1 is a perspective view of a strapping device in accordance with certain embodiments of the invention.
Figure 2:
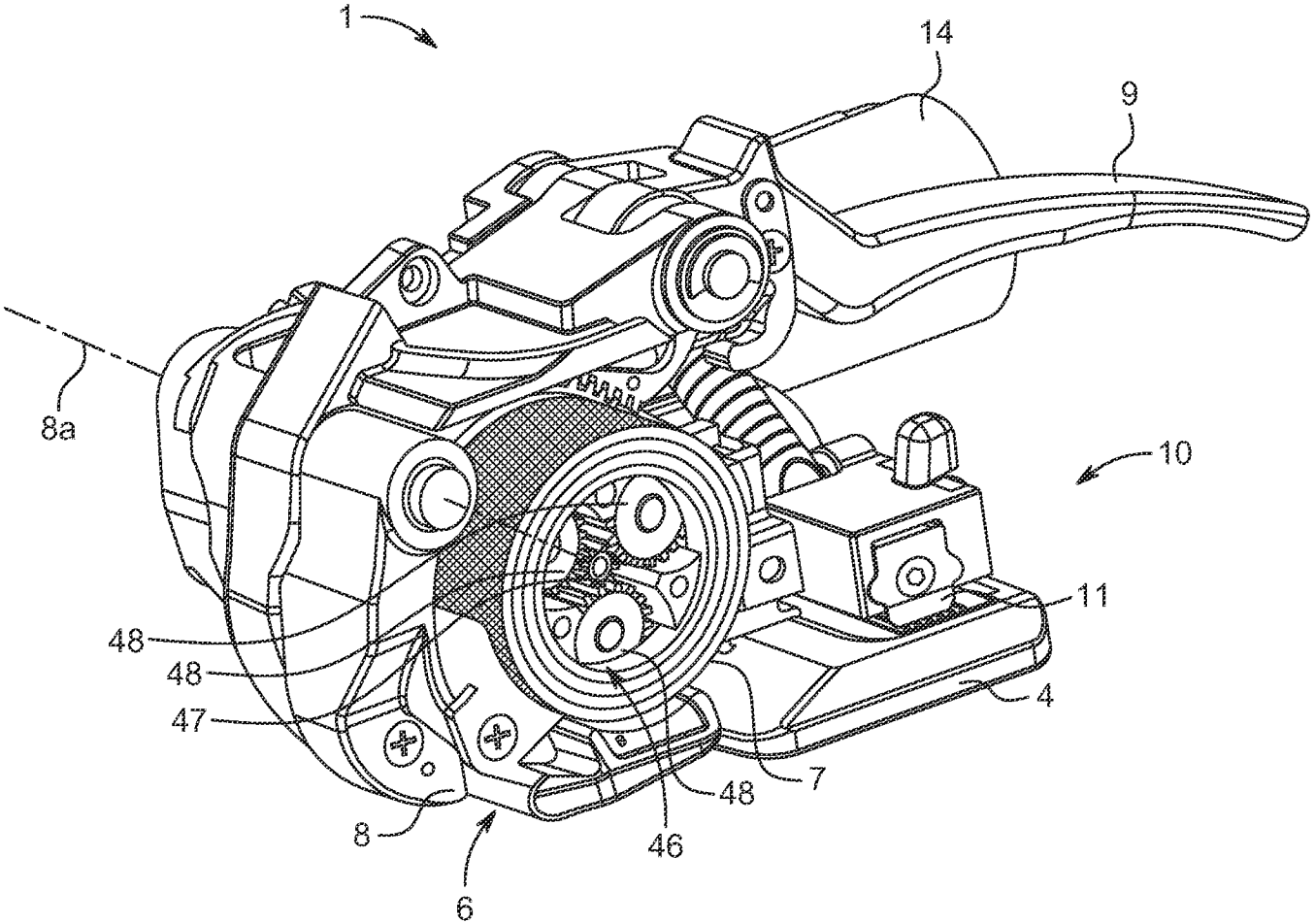
FIG. 2 shows the strapping device in FIG. 1 with the casing.
Figure 10:
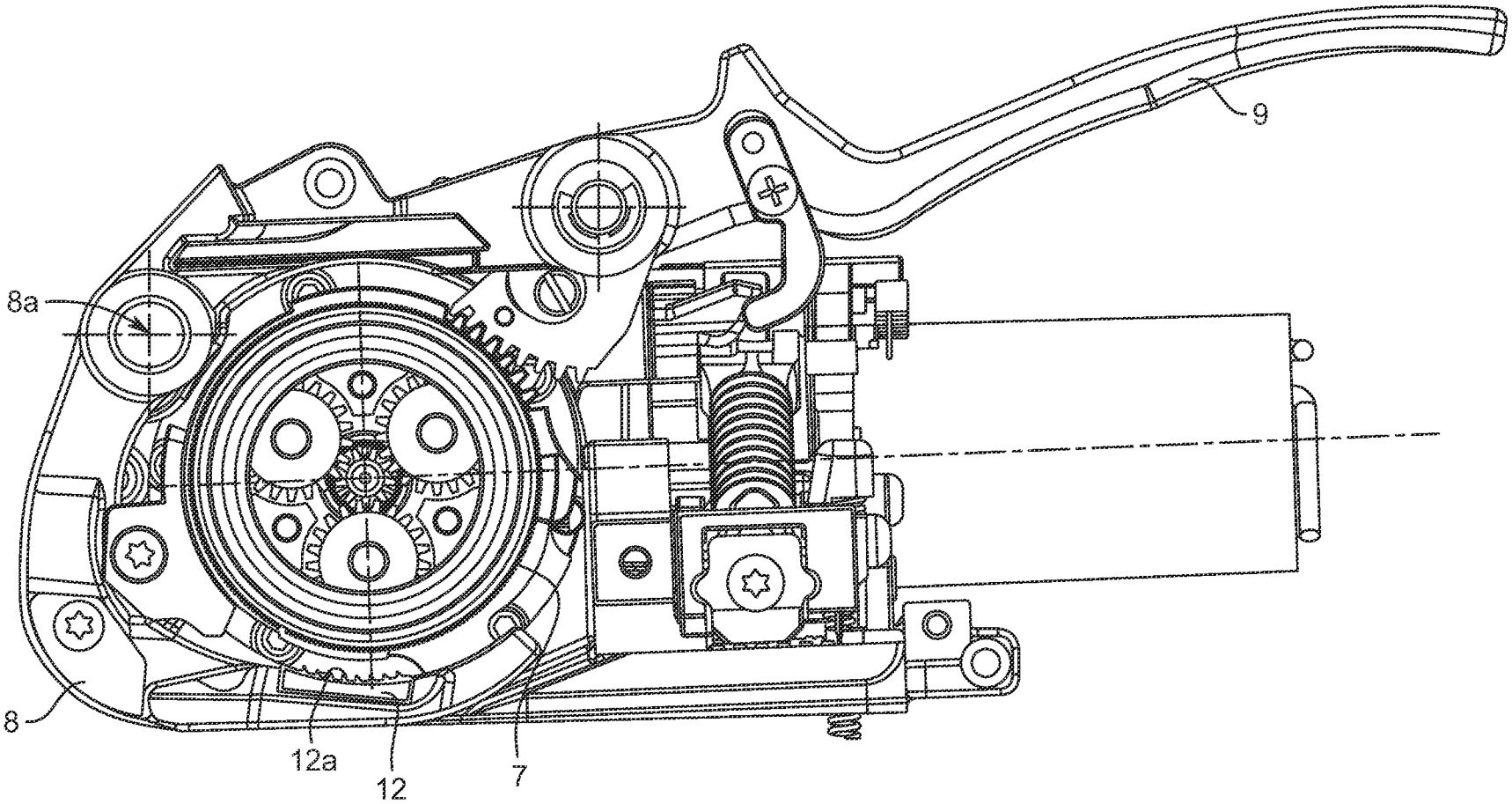
FIG. 10 shows a side view of the tensioner of the strapping device without the casing, in which a tensioning rocker is in a rest position.
Figure 12:
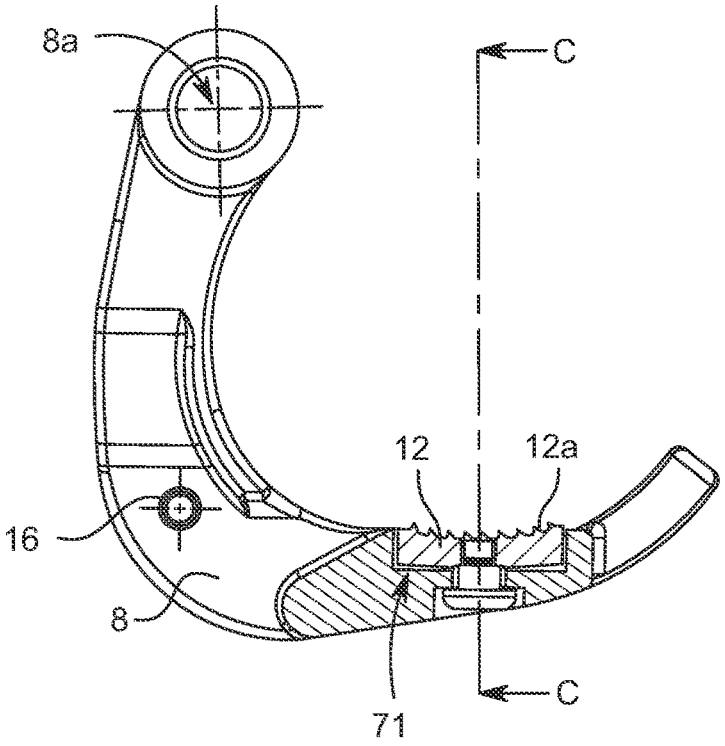
Figure 13:
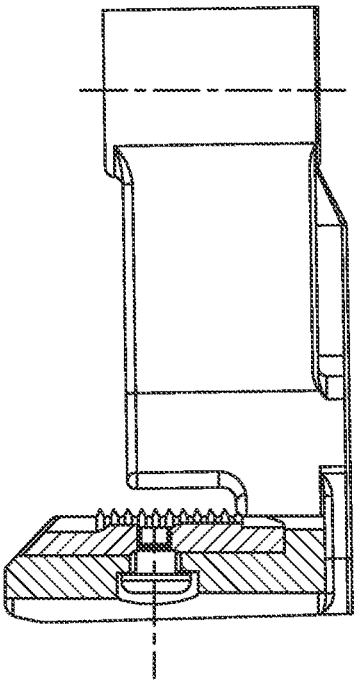
Figure 14:
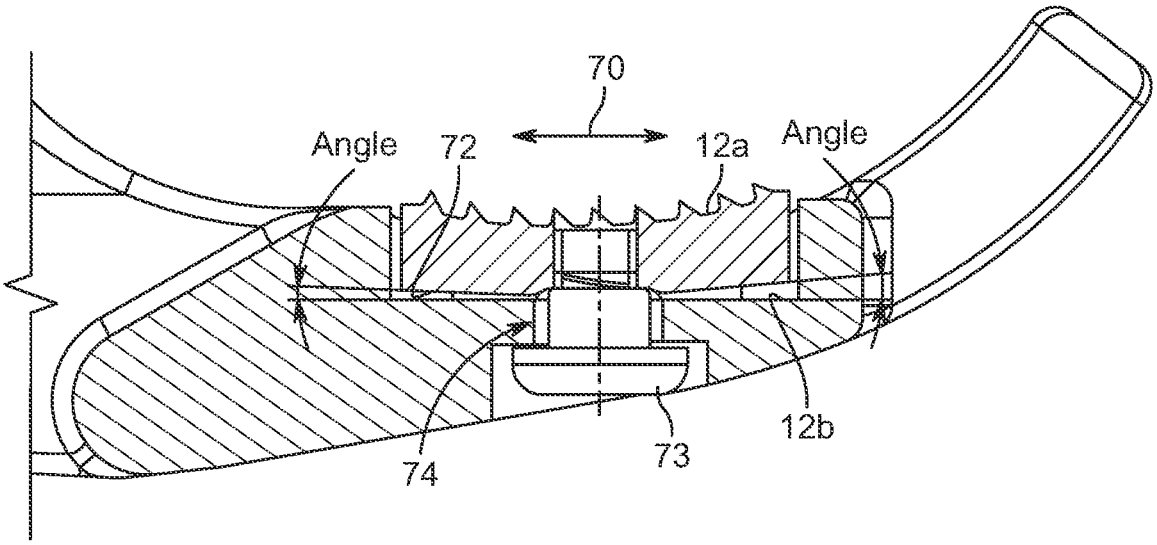

FIG. 12 a side view of the tensioning rocker of the strapping device in FIG. 10 shown in a partial section;

FIG. 13 shows a front view of the tensioning rocker in FIG. 12;

FIG. 14 shows a detail from FIG. 12 along line C-C;

The exclusively manually operated strapping device 1 in accordance with the invention shown in FIGS. 1 and 2 has a casing 2, surrounding the mechanical system of the strapping device, on which a grip 3 for handling the device is arranged. The strapping device also has a base plate 4, the underside of which is intended for placing on an object to be packed. All the functional units of the strapping device 1 are attached on the base place 4 and on the carrier of the strapping device which is connected to the base plate and is not shown in further detail.

With the strapping device 1 a loop of plastic strap, made for example of polypropylene (PP) or polyester (PET), which is not shown in more detail in FIG. 1 and which has previously been placed around the object to be packed, can be tensioned with a tensioner 6 of the strapping device. For this the tensioner has a tensioning wheel 7 with which the strap can be held for a tensioning procedure. The tensioning wheel 7 operates in conjunction with a rocker 8, which by means of a rocker lever 9 can be pivoted from an end position at a distance from the tensioning wheel into a second end position about a rocker pivoting axis 8*a*, in which the rocker 8 is pressed against the tensioning wheel 7. The strap located between the tensioning wheel 7 and the rocker 8 is also pressed against the tensioning wheel 7. By rotating the tensioning wheel 7 it is then possible to provide the strap loop with a strap tension that is high enough for the purpose of packing. The tensioning procedure, and the rocker 8 advantageously designed for this, is described in more detail below.

Subsequently, at a point on the strap loop on which two layers of the wrapping strap are disposed one on top of the other, welding of the two layers can take place by means of the friction welder 8 of the strapping device. In this way the strap loop can be durably connected. For this the friction welder 10 is provided with a welding shoe 11, which through mechanical pressure on the wrapping strap and simultaneous oscillating movement at a predefined frequencies starts to melt the two layers of the wrapping strap. The plastified or melted areas flow into each other and after cooling of the strap a connection is formed between the two strap layers. If necessary the strap loop can be separated from a strap storage roll by means of a strapping device 1 cutter which is not shown.

Operation of the tensioner 6, assignment of the friction welder 10 by means of a transitioning device 19 (FIG. 6) of the friction welder as well as the operation of the friction welder itself and operation of the cutter all take place using only one common electric motor 14, which provides a drive movement for each of these components. For its power supply, an interchangeable storage battery 15, which can be removed for charging, is arranged on the strapping device. The supply of other external auxiliary energies, such as compressed air or additional electricity, is not envisaged in accordance with FIGS. 1 and 2.

The portable mobile strapping device 1 has an operating element 16, in the form of a press switch, which is intended for starting up the motor. Via a switch 17, three operating modes can be set for the operating element 16. In the first mode by operating the operating element 16, without further action being required by the operator, the tensioner 6 and the friction welder 10 are started up consecutively and automatically. To set the second mode the switch 17 is switched over to a second switching mode. In the second possible operating mode, by operating the operating element 16, only the tensioner 6 is started up. To separately start the friction welder 10 a second operating element 18 must be activated by the operator. In alternative forms of embodiment it can also be envisaged that in this mode the first operating element 16 has to be operated twice in order to activate the friction welder. The third mode is a type of semi-automatic operation in which the tensioning button 16 must be pressed until the tension force/tensile force which can preset in stages is achieved in the strap. In this mode it is possible to interrupt the tensioning process by releasing the tensioning button 16, for example in order to position edge protectors on the goods to be strapped under the wrapping strap. By pressing the tensioning button the tensioning procedure can then be continued. This third mode can be combined with a separately operated as well as an automatic subsequent friction welding procedure.

Figure 3:
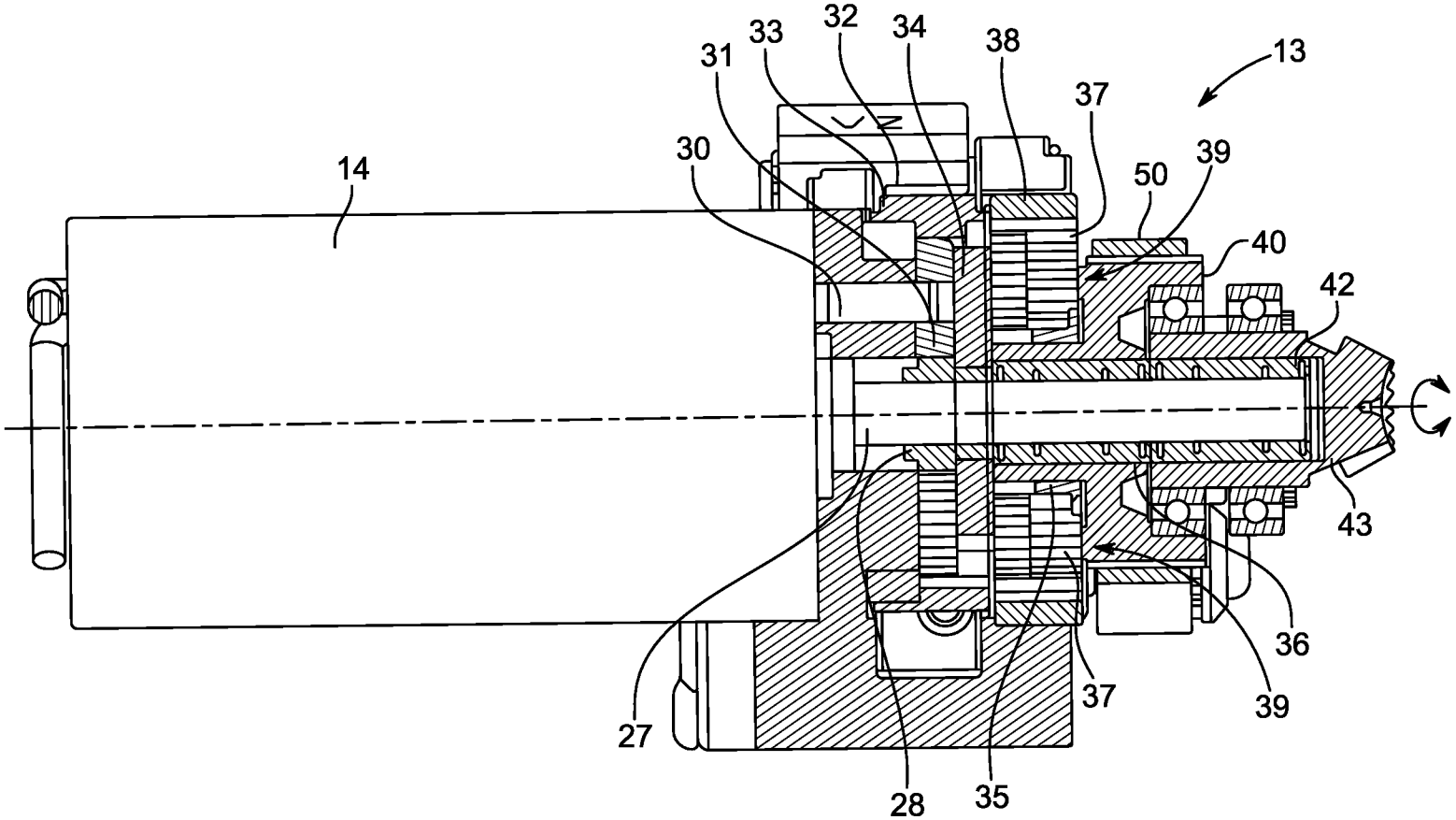
FIG. 3 shows a partial section view of the motor of the strapping device in FIG. 1, together with components arranged on the motor shaft.

On a motor shaft 27, shown in FIG. 3, of the brushless, grooved rotor direct current motor 14 a gearing system device 13 is arranged. In the example of embodiment shown here a type EC140 motor manufactured by Maxon Motor AG, Brünigstrasse 20, 6072 Sachseln is used. The brushless direct current motor 14 can be operated in both rotational directions, whereby one direction is used as the drive movement of the tensioner 6 and the other direction as the drive movement of the welding device 10.

Figure 4:
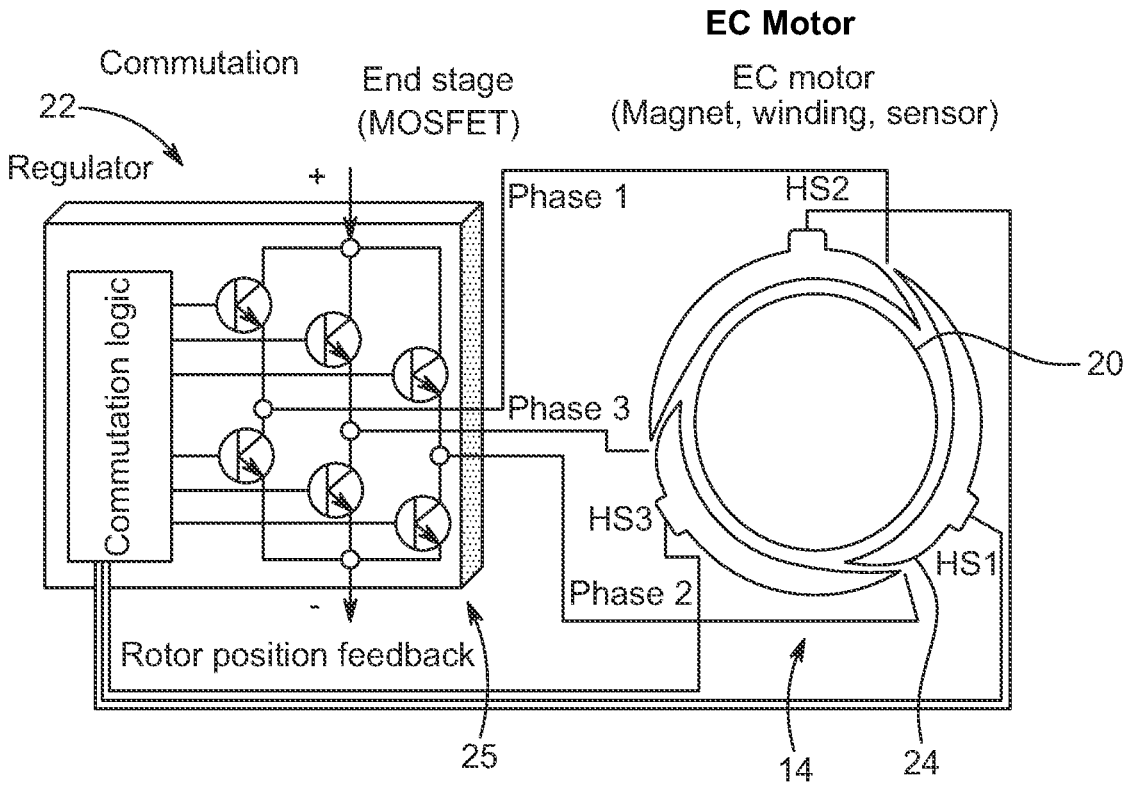
FIG. 4 shows a very schematic view of the motor along with its electronic commutation switch.

The brushless direct current motor 14, shown purely schematically in FIG. 4, is designed with a grooved rotor 20 with three Hall sensors HS1, HS2, HS3. In its rotor 20, this EC motor (electronically commutated motor) has a permanent magnet and is provided with an electronic control 22 intended for electronic commutation in the stator 24. Via the Hall sensors, HS1, HS2, HS3, which in the example of embodiment also assume the function of position sensors, the electronic control 22 determines the current position of the rotor 20 and controls the electrical magnetic field in the windings of the stator 24. The phases (phase 1, phase 2, phase 3) can thus be controlled depending in the position of the rotor 20, in order to bring about a rotational movement of the rotor in a particular rotational direction with a predeterminable variable rotational speed and torque. In this present case a "1st quadrant motor drive intensifier" is used, which provides the motor with the voltage as well as peak and continuous current and regulates these. The current flow for coil windings of the stator 24, which are not shown in more detail, is controlled via a bridge circuit 25 (MOSFET transistors), i.e. commutated. A temperature sensor, which is not shown in more detail, is also provided on the motor. In this way the rotational direction, rotational speed, current limitation and temperature can be monitored and controlled. The commutator is designed as a separate print component and is accommodated in the strapping device separately from the motor.

The power supply is provided by the lithium-ion storage battery 15. Such storage batteries are based on several independent lithium ion cells in each of which essentially separate chemical processes take place to generate a potential difference between the two poles of each cell. In the example of embodiment the lithium ion storage battery is manufactured by Robert Bosch GmbH, D-70745 Leinfelden-Echterdingen. The battery in the example of embodiment has eight cells and has a capacity of 2.6 ampere-hours. Graphite is used as the active material/negative electrode of the lithium ion storage battery. The positive electrode often has lithium metal oxides, more particularly in the form of layered structures. Anhydrous salts, such as lithium hexafluorophosphate or polymers are usually used as the electrolyte. The voltage emitted by a conventional lithium ion storage battery is usually 3.6 volts. The energy density of such storage batteries is around 100 Wh/kh to 120 Wh/kg.

On the motor side drive shaft, the gearing system device 13 has a free wheel 36, on which a sun gear 35 of a first planetary gear stage is arranged. The free wheel 36 only transfers the rotational movement to the sun gear 35 in one of the two possible rotational directions of the drive. The sun gear 35 meshes with three planetary gears 37 which in a known manner engage with a fixed gear 38. Each of the planetary gears 37 is arranged on a shaft 39 assigned to it, each of which is connected in one piece with an output gear 40. The rotation of the planetary gears 37 around the motor shaft 27 produces a rotational movement of the output gear 40 around the motor shaft 27 and determines a rotational speed of this rotational movement of the output gear 40. In addition to the sun gear 35 the output gear 40 is also on the free wheel 36 and is therefore also arranged on the motor shaft. This free wheel 36 ensures that both the sun gear 35 and the output gear 40 only also rotate in one rotational direction of the rotational movement of the motor shaft 27. The free wheel 29 can for example be of type INA HFL0615 as supplied by the company Schaeffler KG, D-91074 Herzogenaurach, On the motor-side output shaft 27 the gear system device 13 also has a toothed sun gear 28 belonging to a second planetary gear stage, through the recess of which the shaft 27 passes, though the shaft 27 is not connected to the sun gear 28. The sun gear is attached to a disk 34, which in turn is connected to the planetary gears. The rotational movement of the planetary gears 37 about the motor-side output shaft 27 is thus transferred to the disk 34, which in turn transfers its rotational movement at the same speed to the sun gear 28. With several planetary gears, namely three, the sun gear 28 meshes with cog gears 31 arranged on a shaft 30 running parallel to the motor shaft 27. The shafts 30 of the three cog gears 31 are fixed, i.e. they do not rotate about the motor shaft 27. In turn the cog gears 21 engage with an internal-tooth sprocket, which on its outer side has a cam 32 and is hereinafter referred to as the cam wheel 33. The sun gear 28, the three cog gears 31 as well as the cam wheel 33 are components of the second planetary gear stage. In the planetary gear system the input-side rotational movement of the shaft 27 and the rotational movement of the cam wheel are at a ratio of 60:1, i.e. a 60-fold reduction takes place through the second-stage planetary gear system.

At the end of the motor shaft 27, on a second free wheel 42 a bevel gear 43 is arranged, which engages in a second bevel gear, which is not shown in more detail. This free wheel 42 also only transmits the rotational movement in one rotational direction of the motor shaft 27. The rotational direction in which the free wheel 36 of the sun gear 35 and the free wheel 42 transmit the rotational movement of the motor shaft 27 is opposite. This means that in one rotational direction only free wheel 36 turns, and in the other rotational direction only free wheel 42.

The second bevel gear is arranged on one of a, not shown, tensioning shaft, which at its other end carries a further planetary gear system 46 (FIG. 2). The drive movement of the electric motor in a particular rotational direction is thus transmitted by the two bevel gears to the tensioning shaft. Via a sun gear 47 as well as three planetary gears 48 the tensioning wheel 49, in the form of an internally toothed sprocket, of the tensioner 6 is rotated. During rotation the tensioning wheel 7, provided with a surface structure on its outer surface, moves the wrapping strap through friction, as a result of which the strap loop is provided with the envisaged tension.

Figure 5:
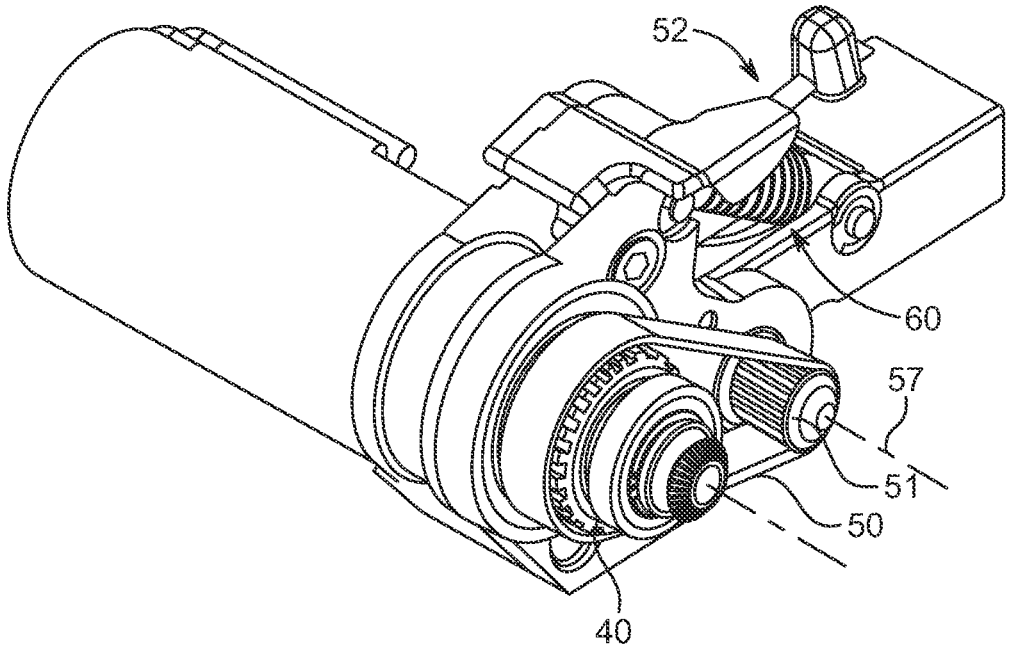
FIG. 5 shows a perspective partial view of the drive train of the strapping device in FIG. 1.
Figure 6:
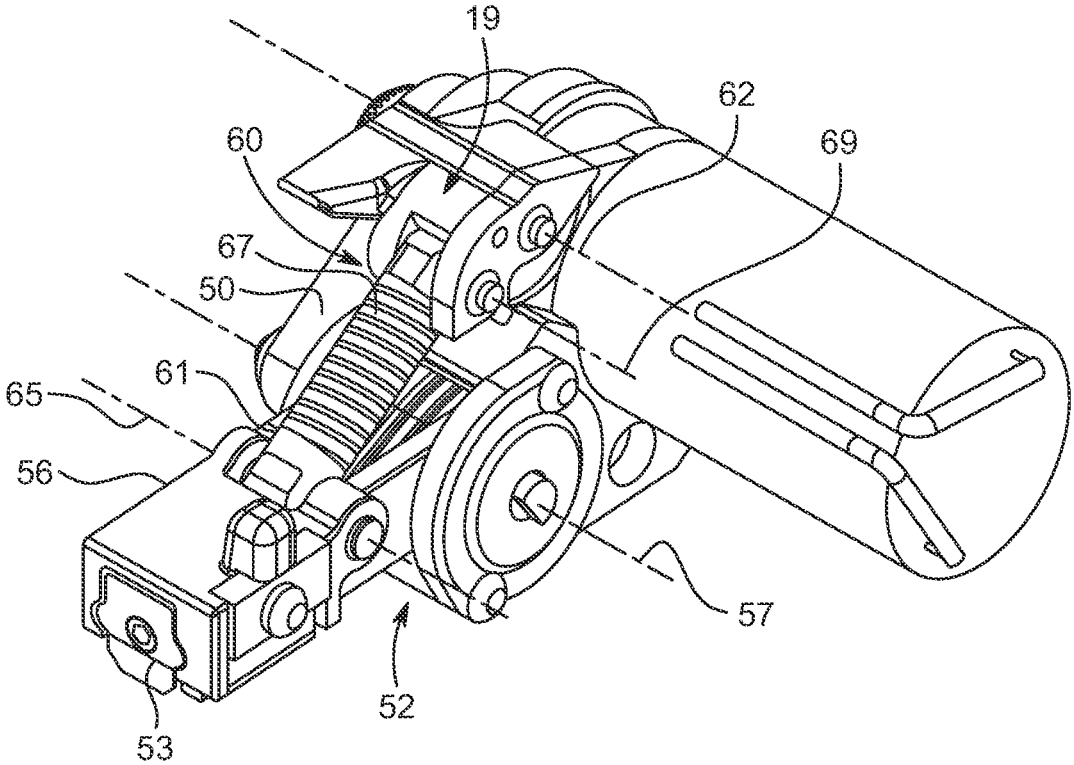
FIG. 6 shows the drive train in FIG. 5 from another direction of view.

In the area of its outer circumference the output gear 40 is designed as a cog gear on which is a toothed belt 50 of an envelope drive (FIGS. 5 and 6). The toothed belt 50 also goes round pinion 51, smaller in diameter than the output gear 40, the shaft of which drive an eccentric drive 52 for producing an oscillating to and fro movement of the welding shoe 53. Instead of toothed belt drive any other form of envelope drive could be provided, such as a V-belt or chain drive. The eccentric drive 52 has an eccentric shaft 54 on which an eccentric tappet 55 is arranged on which in turn a welding shoe arm 56 with a circular recess is mounted. The eccentric rotational movement of the eccentric tappet 55 about the rotational axis 57 of the eccentric shaft 54 results in a translator oscillating to and fro movement of the welding shoe 53. Both the eccentric drive 52 as well as the welding shoe 53 it can be designed in any other previously known manner.

Figure 9:
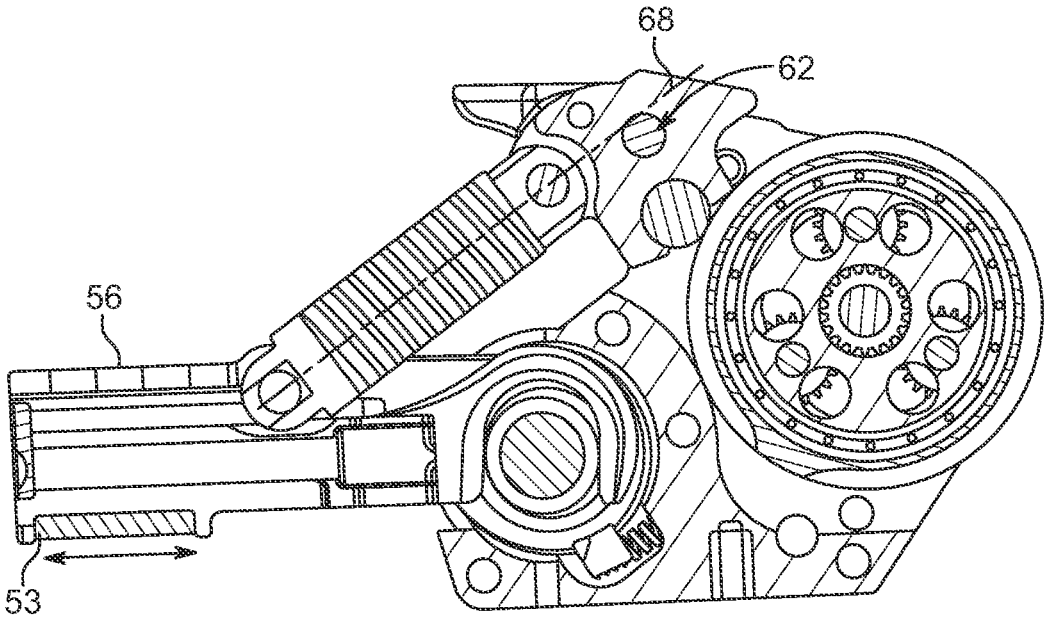
FIG. 9 shows a side view of the drive train in FIG. 5 with the welding device in a welding position.

The welding device is also provided with a toggle lever device 60, by means of which the welding device can be moved from a rest position (FIG. 7) into a welding position (FIG. 9). The toggle lever device 60 is attached to the welding shoe arm 56 and provided with a longer toggle lever 61 pivotably articulated on the welding shoe arm 56. The toggle lever device 60 is also provided with a pivoting element 63, pivotably articulated about a pivoting axis 62, which in the toggle level device 60 acts as the shorter toggle lever. The pivoting axis 62 of the pivoting element 63 runs parallel to the axes of the motor shaft 27 and the eccentric shaft 54.

Figure 7:
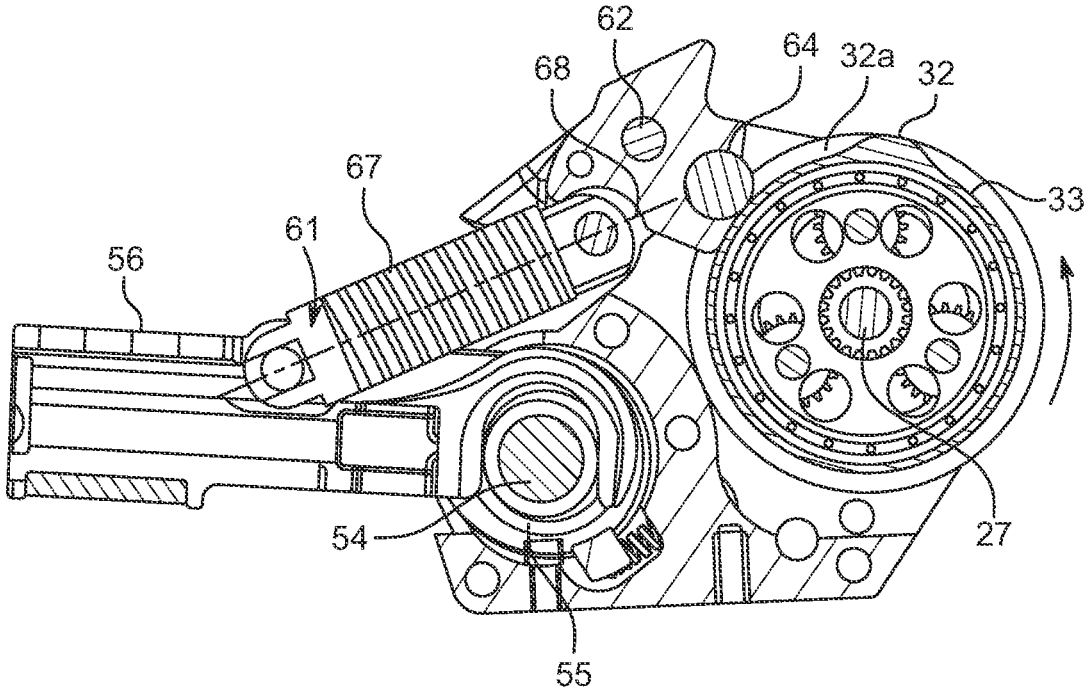
FIG. 7 shows a side view of the drive train in FIG. 5 with the welding device in the rest position.
Figure 8:
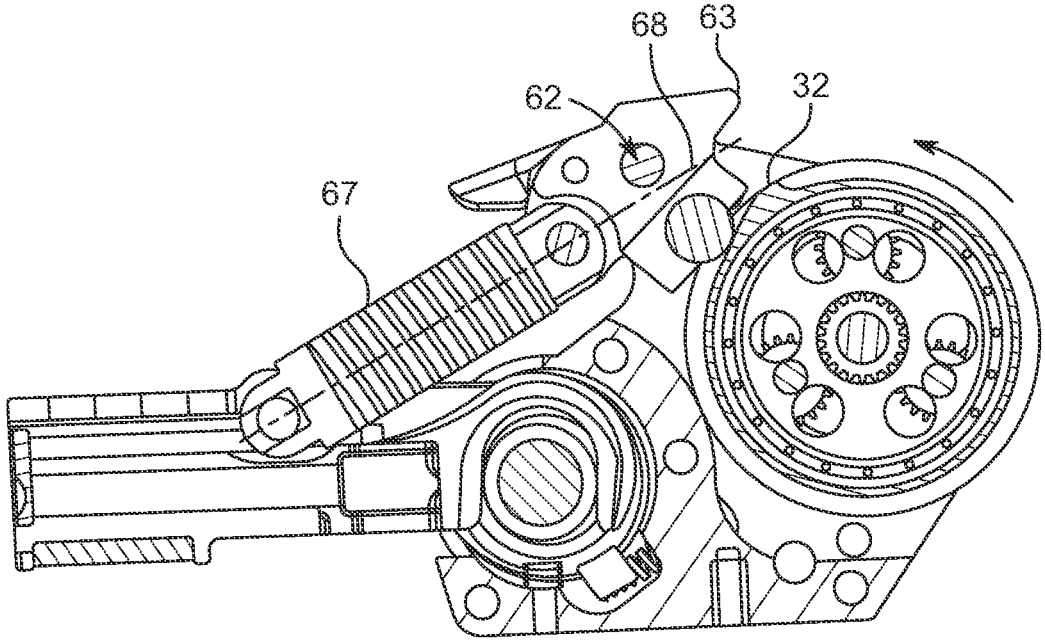
FIG. 8 shows a side view of the drive train in FIG. 6 with the welding device in a position between two end positions.

The pivoting movement is initiated by the cam 32 on the cam wheel 33 which during rotational movement in the anticlockwise direction—in relation to the depictions in FIGS. 7 to 9—of the cam wheel 33 ends up under the pivoting element 63 (FIG. 8). A ramp-like ascending surface 32*a* of the cam 32 comes into contact with a contact element 64 set into the pivoting element 63. The pivoting element 63 is thus rotated clockwise about its pivoting axis 62. In the area of a concave recess of the pivoting element 63 a two-part longitudinally-adjustable toggle lever rod of the toggle lever 61 is pivotably arranged about a pivoting axis 69 in accordance with the 'piston cylinder' principle. The latter is also rotatably articulated on an articulation point 65, designed as a further pivoting axis 65, of the welding shoe arm 56 in the vicinity of the welding shoe 53 and at a distance from the rotational axis 57 of the welding shoe arm 56. Between both ends of the longitudinally adjustable toggle lever rod a pressure spring 67 is arranged thereon, by means of which the toggle lever 61 is pressed against both the welding shoe arm 56 as well as against the pivoting element 63. In terms of its pivoting movements the pivoting element 63 is thus functionally connected to the toggle lever 61 and the welding shoe arm 56.

As can be seen in the depictions in FIGS. 7, in the rest position there is an (imaginary) connecting line 68 for both articulation points of the toggle lever 61 running through the toggle lever 61 between the pivoting axis 62 of the pivoting element 63 and the cam wheel 33, i.e. on one side of the pivoting axis 62. By operating the cam wheel 33 the pivoting element 63 is rotated clockwise—in relation to the depictions in FIGS. 7 to 9. In this way the toggle lever 61 of the pivoting 63 is also operated. In FIG. 8 an intermediate position of the toggle lever 61 is shown in which the connecting line 68 of the articulation points 65, 69 intersects the pivoting axis 62 of the pivoting element 63. In the end position of the movement (welding position) shown in FIG. 9 the toggle lever 61 with its connecting line 68 is then on the other side of the pivoting axis 62 of the pivoting element 63 in relation to the cam wheel 33 and the rest position. During this movement the welding arm shoe 56 is transferred by the toggle lever 61 from its rest position into the welding position by rotation about the rotational axis 57. In the latter position the pressure spring 67 presses the pivoting element 63 against a stop, not shown in further detail, and the welding shoe 53 onto the two strap layers to be welded together. The toggle lever 61, and therefore also the welding shoe arm 56, is thus in a stable welding position.

The anticlockwise drive movement of the electric motor shown in FIGS. 6 and 9 is transmitted by the toothed belt 50 to the welding shoe 53, brought into the welding position by the toggle lever device 60, which is pressed onto both strap layer and moved to and fro in an oscillating movement. The welding time for producing a friction weld connection is determined by way of the adjustable number of revolutions of the cam wheel 33 being counted as of the time at which the cam 32 operates the contact element 64. For this the number of revolutions of the shaft 27 of the brushless direct current motor 14 is counted in order to determine the position of the cam wheel 33 as of which the motor 14 should switch off and thereby end the welding procedure. It should be avoided that on switching off the motor 14 the cam 32 comes to a rest under the contact element 64. Therefore, for switching off the motor 14 only relative positions of the cam 32 with regard to the pivoting element 63 are envisaged, a which the cam 32 is not under the pivoting element. This ensures that the welding shoe arm 56 can pivot back from the welding position into the rest position (FIG. 7). More particularly, this avoids a position of the cam 32 at which the cam 32 would position the toggle lever 61 at a dead point, i.e. a position in which the connecting line 68 of the two articulation points intersects the pivoting axis 62 of the pivoting element 63—as shown in FIG. 8. As such a position is avoided, by means of operating the rocker lever the rocker (FIG. 2) can be released from the tensioning wheel 7 and the toggle lever 61 pivoted in the direction of the cam wheel 33 into the position shown in FIG. 7. After the strap loop has been taken out of the strapping device, the latter is ready for a further strapping procedure.

The described consecutive procedures "tensioning" and "welding" can be jointly initiated in one switching status of the operating element 16. For this the operating element 16 is operated once, whereby the electric motor 14 first turns on the first rotational direction and thereby (only) the tensioner 6 is driven. The strap tension to be applied to the strap can be set on the strapping device, preferably be means of a push button in nine stages, which correspond to nine different strap tensions. Alternatively continuous adjustment of the strap tension can be envisaged. As the motor current is dependent on the torque of the tensioning wheel 7, and this in turn on the current strap tension, the strap tension to be applied can be set via push buttons in nine stages in the form of a motor current limit value on the control electronics of the strapping device.

After reaching a settable and thus predeterminable limit value for the motor current/strap tension, the motor 14 is switched off by its control device 22. Immediately afterwards the control device 22 operates the motor in the opposite rotational direction. As a result, in the manner described above, the welding shoe 52 is lowered onto the two layers of strap displaced one on top of the other and the oscillating movement of the welding shoe is carried out to produce the friction weld connection.

By operating switch 17 the operating element 16 can only activate the tensioner. If this is set, by operating the operating element only the tensioner is brought into operation and on reaching the preset strap tension is switched off again. To start the friction welding procedure the second operating element 18 must be operated. However, apart from separate activation, the function of the friction welding device is identical the other mode of the first operating element.

Figure 11:
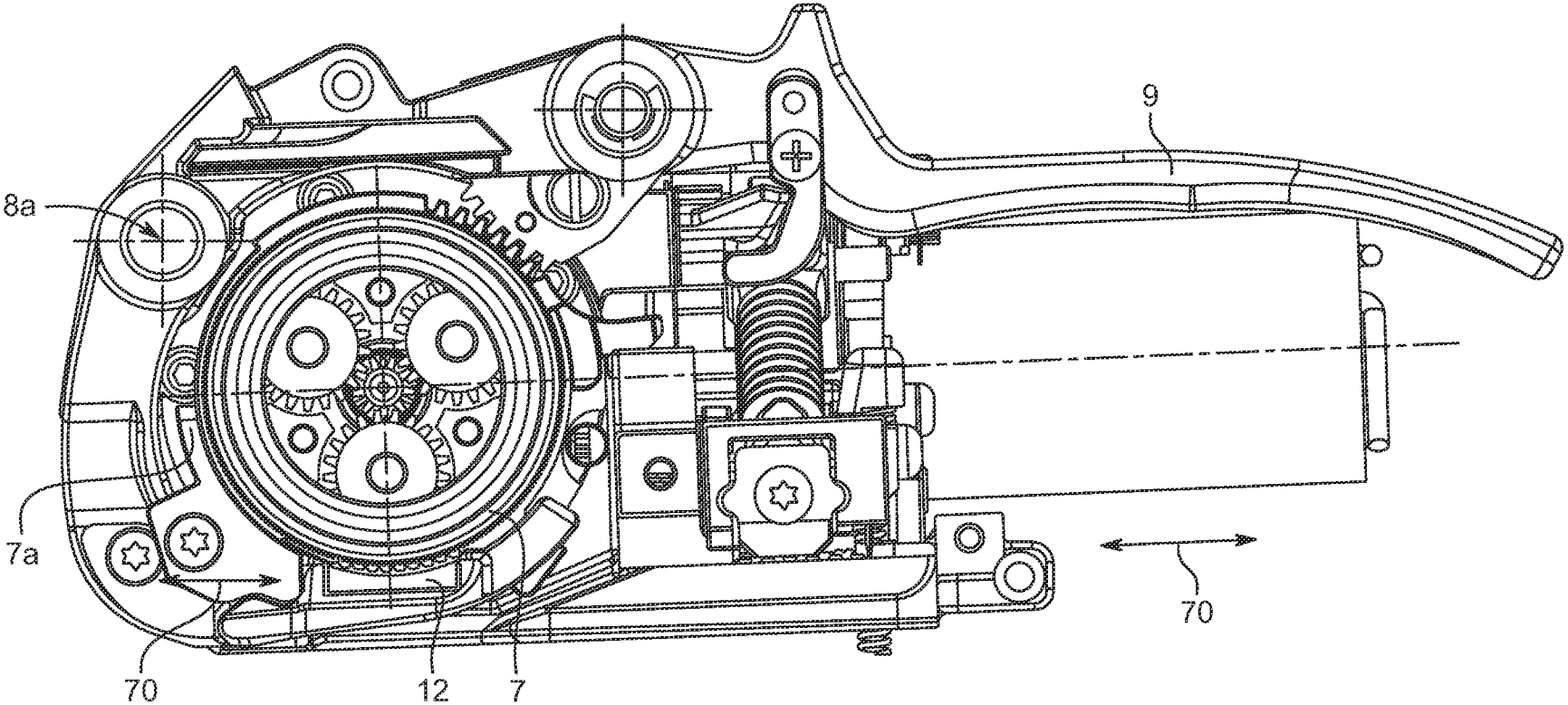
FIG. 11 shows a side view of the tensioner of the strapping device without the casing in which a tensioning rocker is in a tensioning position.

As has already been explained, the rocker 8 can through operating the rocker lever 9 shown in FIGS. 2, 10, 11 carry out pivoting movements about the rocker axis 8*a*. For this, the rocker is moved by a rotating cam disc which is behind the tensioning wheel 7 and cannot therefore be seen in FIG. 2. Via the rocker lever 9 the cam disc can carry out a rotational movement of approximately 30° and move the rocker 8 and/or the tensioning plate 12 relative to the tensioning wheel 7 which allow the strap to be inserted into the strapping device/between the tensioning wheel 7 and tensioning plate 12.

In this way, the toothed tensioning plate arranged on the free end of the rocker can be pivoted from a rest position shown in FIG. 10 into a tensioning position shown in FIG. 11 and back again. In the rest position the tensioning plate 12 is at sufficiently great distance from the tensioning wheel 7 that a wrapping strap can be placed in two layers between the tensioning wheel and the tensioning plate as required for producing connection on a strap loop. In the tensioning position the tensioning plate 12 is pressed in a known way, for example by means of a spring force acting on the rocker, against the tensioning wheel 7, whereby, contrary to what is shown in FIG. 11, in a strapping procedure the two-layer strap is located between the tensioning plate and the tensioning wheel and thus there should be no contact between the two latter elements. The toothed surface 12*a* (tensioning surface) facing the tensioning wheel 7 is concavely curved whereby the curvature radius corresponds with the radius of the tensioning wheel 7 or is slightly larger.

As can be seen in particular in FIGS. 10 and 11 as well as the detailed drawings of FIG. 12-14, the toothed tensioning plate 12 is arranged in a grooved recess 71 of the rocker. The length—in relation to the direction of the strap—of the recess 71 is greater than the length of the tensioning plate 12. In addition, the tensioning plate 12 is provide with a convex contact surface 12*b* with which it is arranged on a flat contact surface 71 in the recess 71 of the rocker 8. As shown in particular in FIGS. 11 and 12 the convex curvature runs in a direction parallel to the strap direction 70, while the contact surface 12*b* is designed flat and perpendicular to this direction (FIG. 13). As a result of this design the tensioning plate 12 is able to carry out pivoting movements in the strap direction 70 relative to the rocker 8 and to the tensioning wheel 7. The tensioning plate 12 is also attached to the rocker 8 by means of a screw 72 passing through the rocker from below. This screw is in an elongated hole 74 of the rocker, the longitudinal extent of which runs parallel to the course of the strap 70 in the strapping device. As a result in addition to be pivotable, the tensioning plate 12 is also arranged on the rocker 8 in a longitudinally adjustable manner.

In a tensioner the tensioning rocker 8 is initially moved from the rest position (FIG. 10) into the tensioning position (FIG. 11). In the tensioning position the sprung rocker 8 presses the tensioning plate in the direction of the tensioning wheel and thereby clamps the two strap layers between the tensioning wheel 7 and the tensioning plate 12. Due to different strap thicknesses this can result in differing spacings between the tensioning plate 12 and circumferential surface 7*a* of the tensioning wheel 7. This not only results in different pivoting positions of the rocker 8, but also different positions of the tensioning plate 12 in relation to the circumferential direction of the tensioning wheel 7. In order to still achieve uniform pressing conditions, during the pressing procedure the tensioning plate 12 adjusts itself to the strap through a longitudinal movement in the recess 71 as well as a pivoting movement via the contact surface 12*b* on contact surface 72 so that the tensioning plate 12 exerts as even a pressures as possible over its entire length on the wrapping strap. If the tensioning wheel 7 is then switched on the toothing of tensioning plate 12 holds the lower strap layer fast, while the tensioning wheel 7 grasps the upper strap layer with its toothed circumferential surface 7*a*. The rotational movement of the tensioning wheel 7 as well the lower coefficient of friction between the two strap layers then results in the tensioning wheel pulling back the upper band layer, thereby increasing the tension in the strap loop up to the required tensile force value.

LIST OF REFERENCES

| | | | |
|---|---|---|---|
| 1. | Strapping device | 37. | Planetary gear |
| 2. | Casing | 38. | Socket |
| 3. | Grip | 39. | Shaft |
| 4. | Base plate | 40. | Output gear |
| 6. | Tensioner | 42. | Free wheel |
| 7. | Tensioning wheel | 43. | Bevel gear |
| 7a. | Circumferential surface | 46. | Planetary gear system |
| 8. | Rocker | 47. | Sun gear |
| 8. | Rocker pivoting axis | 48. | Planetary gear |
| 9. | Rocker lever | 49. | Tensioning wheel |
| 10. | Friction welder | 50. | Toothed belt |
| 11. | Welding shoe | 51. | Pinion |
| 12. | Tensioning plate | 52. | Eccentric drive |
| 12a. | Tensioning surface | 53. | Welding shoe |
| 12b. | Contact surface | 54. | Eccentric shaft |
| 13. | Gear system device | 55. | Eccentric tappet |
| 14. | Electric direct current motor | 56. | Welding shoe arm |
| 15. | Storage battery | 57. | Rotational axis eccentric shaft |
| 16. | Operating element | 60. | Toggle lever device |
| 17. | Switch | 61. | Longer toggle lever |
| 18. | Operating element | 62. | Pivoting axis |
| 19. | Transitioning device | 63. | Pivoting element |
| 20. | Rotor | 64. | Contact element |
| 24. | Stator | 65. | Pivoting axis |
| 25. | Bridging circuit | 66. | Pivoting axis |
| 27. | Motor side output shaft | 67. | Pressure spring |
| 28. | Sun gear | 68. | Connecting line |
| 30. | Shaft | 69. | Pivoting axis |
| 31. | Cog wheel | 70. | Strap direction |
| 32. | Cam | 71. | Recess |
| 32a. | Surface | 72. | Contact surface |
| 33. | Cam wheel | 73. | Screw |
| 35. | Sun gear | 74. | Elongated hole |
| 36. | Free wheel | HS2 | Hall sensor |
| HS1 | Hall sensor | HS3 | Hall sensor |

The invention claimed is:

1. A strapping device comprising:

a tensioning wheel;

a strap connector operable to connect two areas of a strap to one another, the strap connector movable from a rest position downward to a connecting position and from the connecting position upward to the rest position;

a pivoting element;

a toggle lever coupled to the pivoting element and to the strap connector; and a spring circumscribing at least part of the toggle lever, wherein the pivoting element and the toggle lever are movable between a first configuration and a second configuration different from the first configuration, wherein the strap connector is in the rest position when the pivoting element and the toggle lever are in the first configuration and in the connecting position when the pivoting element and the toggle lever are in the second configuration, wherein the spring is configured to, when the pivoting element and the toggle lever are in the second configuration, exert a first force on the pivoting element and a second force on the toggle lever.

2. The strapping device of claim 1, wherein the pivoting element and the toggle lever are pivotable between the first and second configurations.

3. The strapping device of claim 2, wherein the pivoting element and the toggle lever pivot in different directions when moving from the first configuration to the second configuration.

4. The strapping device of claim 3, wherein the toggle lever is longitudinally adjustable.

5. The strapping device of claim 4, wherein the toggle lever comprises a first end coupled to the pivoting element and a second end coupled to the strap connector.

6. The strapping device of claim 5, wherein the spring is configured to, when the pivoting element and the toggle lever are in the second configuration, force the first and second ends of the toggle lever away from one another to exert the first force on the pivoting element and the second force on the toggle lever.

7. The strapping device of claim 3, further comprising:

a first pin defining a first pivot axis about which the pivoting element is pivotable;

a second pin coupling the pivoting element and the toggle lever and defining a second pivot axis; and a third pin coupling the toggle lever and the strap connector and defining a third pivot axis.

8. The strapping device of claim 7, wherein when the pivoting element and the toggle lever are in the first configuration, a first angle is defined between a first line extending through the first pivot axis and the second pivot axis and a second line extending through the second pivot axis and the third pivot axis, wherein the first and second lines are coplanar.

9. The strapping device of claim 8, wherein when the pivoting element and the toggle lever are in the second configuration, a second angle is defined between the first and second lines, wherein the first and second angles are different.

10. The strapping device of claim 9, wherein the first and second lines are nonparallel when the pivoting element and the toggle lever are in the first configuration and when the pivoting element and the toggle lever are in the second configuration.

11. The strapping device of claim 10, wherein the pivoting element and the toggle lever have a third configuration different from the first and second configurations at a point in time when the pivoting element and the toggle lever are moving from the first configuration to the second configuration, wherein a 180-degree angle is defined between the first and second lines when the pivoting element and the toggle lever are in the third configuration.

12. The strapping device of claim 10, wherein the second line extends across a first side of the first pivot axis when the pivoting element and the toggle lever are in the first configuration, wherein the second line extends across a second side of the first pivot axis opposite the first side when the pivoting element and the toggle lever are in the second configuration.

13. The strapping device of claim 9, wherein when in the second configuration, the pivoting element and the toggle lever are oriented such that the first force the spring exerts on the pivoting element and the second force the spring exerts on the strap connector retain the pivoting element and the toggle lever in the second configuration.

14. The strapping device of claim 7, further comprising a drive device operable to cause the pivoting element and the toggle lever to move from the first configuration to the second configuration.

15. The strapping device of claim 14, further comprising an engaging element, wherein the drive device is configured to move the engaging element into engagement with the pivoting element to cause the pivoting element to move, thereby causing the pivoting element and the toggle lever to move from the first configuration to the second configuration.

16. The strapping device of claim 15, wherein the pivoting element comprises a contact element, wherein the drive device is configured to move the engaging element into engagement with the contact element to cause the pivoting element to move.

17. The strapping device of claim 15, wherein the engaging element comprises a cam wheel having a cam thereon, wherein the drive device is configured to rotate the cam wheel, wherein the cam wheel is positioned so rotation of the cam wheel results in the cam contacting the pivoting element and causing the pivoting element to pivot, thereby causing the toggle lever to pivot and the connecting device to move from the rest position downward to the connecting position until the pivoting element and the toggle lever reach the second configuration.

18. The strapping device of claim 15, wherein the toggle lever is longitudinally adjustable, wherein the toggle lever comprises a first end coupled to the pivoting element and a second end coupled to the strap connector, wherein the spring is configured to, when the pivoting element and the toggle lever are in the second configuration, force the first and second ends of the toggle lever away from one another to exert the first force on the pivoting element and the second force on the strap connector.

19. The strapping device of claim 18, wherein when in the second configuration, the pivoting element and the toggle lever are oriented such that the first force the spring exerts on the pivoting element and the second force the spring exerts on the strap connector retain the pivoting element and the toggle lever in the second configuration.

20. The strapping device of claim 19, wherein when the pivoting element and the toggle lever are in the first configuration, a first angle is defined between a first line extending through the first pivot axis and the second pivot axis and a second line extending through the second pivot axis and the third pivot axis, wherein the first and second lines are coplanar, wherein when the pivoting element and the toggle lever are in the second configuration, a second angle is defined between the first and second lines, wherein the first and second angles are different, wherein the first and second lines are nonparallel when the pivoting element and the toggle lever are in the first configuration and when the pivoting element and the toggle lever are in the second configuration, wherein the pivoting element and the toggle lever have a third configuration different from the first and second configurations at a point in time when the pivoting element and the toggle lever are moving from the first configuration to the second configuration, wherein a 180-degree angle is defined between the first and second lines when the pivoting element and the toggle lever are in the third configuration.

21. The strapping device of claim 20, wherein the second line extends across a first side of the first pivot axis when the pivoting element and the toggle lever are in the first configuration, wherein the second line extends across a second side of the first pivot axis opposite the first side when the pivoting element and the toggle lever are in the second configuration.

22. The strapping device of claim 14, wherein the drive device comprises a motor.

23. The strapping device of claim 22, wherein the motor comprises a brushless direct current motor.

24. The strapping device of claim 22, wherein the motor comprises a motor shaft operably connected to the tensioning wheel, the strap connector, and the pivoting element.

25. The strapping device of claim 24, further comprising a control device configured to control the motor to rotate the motor shaft in:

a first rotational direction to cause the pivoting element and the toggle lever to move from the first configuration to the second configuration to move the strap connector from the rest position downward to the connecting position and to cause the strap connector to operate; and a second rotational direction opposite the first rotational direction to cause the tensioning wheel to rotate.

26. The strapping device of claim 14, wherein the strap connector comprises a welding shoe, a welding shoe arm housing the welding shoe, and an eccentric drive operably connected to the welding shoe to cause the welding shoe to oscillate.

27. The strapping device of claim 26, wherein the drive device is operably connected to the eccentric drive to rotate the eccentric drive to cause the welding shoe to oscillate.

28. The strapping device of claim 27, further comprising an output gear and an endless belt operably connecting the output gear to the eccentric drive to rotate the eccentric drive, wherein the drive device is operably connected to the output gear to rotate the output gear.

29. The strapping device of claim 14, further comprising a rocker lever operable to cause the pivoting element and the toggle lever to move from the second configuration to the first configuration, thereby moving the strap connector from the connecting position upward to the rest position.

30. A strapping device comprising:

a tensioning wheel;

a strap connector operable to connect two areas of a strap to one another, the strap connector movable from a rest position downward to a connecting position and from the connecting position upward to the rest position;

a pivoting element;

a toggle lever comprising a first end coupled to the pivoting element and a second end coupled to the strap connector; and a spring, wherein the pivoting element and the toggle lever are movable between a first configuration and a second configuration different from the first configuration, wherein the strap connector is in the rest position when the pivoting element and the toggle lever are in the first configuration and in the connecting position when the pivoting element and the toggle lever are in the second configuration, wherein the spring is configured to, when the pivoting element and the toggle lever are in the second configuration, force the first and second ends of the toggle lever away from one another to exert a first force on the pivoting element and a second force on the toggle lever.

31. The strapping device of claim 30, wherein the pivoting element and the toggle lever are pivotable between the first and second configurations.

32. The strapping device of claim 31, wherein the pivoting element and the toggle lever pivot in different directions when moving from the first configuration to the second configuration.

33. The strapping device of claim 30, wherein the toggle lever is longitudinally adjustable.

34. The strapping device of claim 30, wherein the spring circumscribes at least part of the toggle lever.

35. The strapping device of claim 30, further comprising:

a first pin defining a first pivot axis about which the pivoting element is pivotable;

a second pin coupling the pivoting element and the toggle lever and defining a second pivot axis; and a third pin coupling the toggle lever and the strap connector and defining a third pivot axis.

36. A strapping device comprising:

a tensioning wheel;

a strap connector operable to connect two areas of a strap to one another, the strap connector movable from a rest position downward to a connecting position and from the connecting position upward to the rest position;

a pivoting element;

a toggle lever coupled to the pivoting element and to the strap connector;

a first pin defining a first pivot axis about which the pivoting element is pivotable;

a second pin coupling the pivoting element and the toggle lever and defining a second pivot axis;

a third pin coupling the toggle lever and the strap connector and defining a third pivot axis; and a spring, wherein the pivoting element and the toggle lever are pivotable between a first configuration and a second configuration different from the first configuration, wherein the pivoting element and the toggle lever pivot in different directions when moving from the first configuration to the second configuration, wherein the strap connector is in the rest position when the pivoting element and the toggle lever are in the first configuration and in the connecting position when the pivoting element and the toggle lever are in the second configuration, wherein the spring is configured to, when the pivoting element and the toggle lever are in the second configuration, exert a first force on the pivoting element and a second force on the toggle lever.

37. The strapping device of claim 36, wherein when the pivoting element and the toggle lever are in the first configuration, a first angle is defined between a first line extending through the first pivot axis and the second pivot axis and a second line extending through the second pivot axis and the third pivot axis, wherein the first and second lines are coplanar.

38. The strapping device of claim 37, wherein when the pivoting element and the toggle lever are in the second configuration, a second angle is defined between the first and second lines, wherein the first and second angles are different.

39. The strapping device of claim 38, wherein the first and second lines are nonparallel when the pivoting element and the toggle lever are in the first configuration and when the pivoting element and the toggle lever are in the second configuration.

40. The strapping device of claim 39, wherein the pivoting element and the toggle lever have a third configuration different from the first and second configurations at a point in time when the pivoting element and the toggle lever are moving from the first configuration to the second configuration, wherein a 180-degree angle is defined between the first and second lines when the pivoting element and the toggle lever are in the third configuration.

41. The strapping device of claim 39, wherein the second line extends across a first side of the first pivot axis when the pivoting element and the toggle lever are in the first configuration, wherein the second line extends across a second side of the first pivot axis opposite the first side when the pivoting element and the toggle lever are in the second configuration.

42. The strapping device of claim 38, wherein when in the second configuration, the pivoting element and the toggle lever are oriented such that the first force the spring exerts on the pivoting element and the second force the spring exerts on the strap connector retain the pivoting element and the toggle lever in the second configuration.

43. The strapping device of claim 36, further comprising a drive device operable to cause the pivoting element and the toggle lever to move from the first configuration to the second configuration.

44. The strapping device of claim 43, further comprising an engaging element, wherein the drive device is configured to move the engaging element into engagement with the pivoting element to cause the pivoting element to move, thereby causing the pivoting element and the toggle lever to move from the first configuration to the second configuration.

45. The strapping device of claim 44, wherein the pivoting element comprises a contact element, wherein the drive device is configured to move the engaging element into engagement with the contact element to cause the pivoting element to move.

46. The strapping device of claim 44, wherein the engaging element comprises a cam wheel having a cam thereon, wherein the drive device is configured to rotate the cam wheel, wherein the cam wheel is positioned so rotation of the cam wheel results in the cam contacting the pivoting element and causing the pivoting element to pivot, thereby causing the toggle lever to pivot and the connecting device to move from the rest position downward to the connecting position until the pivoting element and the toggle lever reach the second configuration.

47. The strapping device of claim 44, wherein the toggle lever is longitudinally adjustable, wherein the toggle lever comprises a first end coupled to the pivoting element and a second end coupled to the strap connector, wherein the spring is configured to, when the pivoting element and the toggle lever are in the second configuration, force the first and second ends of the toggle lever away from one another to exert the first force on the pivoting element and the second force on the strap connector.

48. The strapping device of claim 47, wherein when in the second configuration, the pivoting element and the toggle lever are oriented such that the first force the spring exerts on the pivoting element and the second force the spring exerts on the strap connector retain the pivoting element and the toggle lever in the second configuration.

49. The strapping device of claim 48, wherein when the pivoting element and the toggle lever are in the first configuration, a first angle is defined between a first line extending through the first pivot axis and the second pivot axis and a second line extending through the second pivot axis and the third pivot axis, wherein the first and second lines are coplanar, wherein when the pivoting element and the toggle lever are in the second configuration, a second angle is defined between the first and second lines, wherein the first and second angles are different, wherein the first and second lines are nonparallel when the pivoting element and the toggle lever are in the first configuration and when the pivoting element and the toggle lever are in the second configuration, wherein the pivoting element and the toggle lever have a third configuration different from the first and second configurations at a point in time when the pivoting element and the toggle lever are moving from the first configuration to the second configuration, wherein a 180-degree angle is defined between the first and second lines when the pivoting element and the toggle lever are in the third configuration.

50. The strapping device of claim 49, wherein the second line extends across a first side of the first pivot axis when the pivoting element and the toggle lever are in the first configuration, wherein the second line extends across a second side of the first pivot axis opposite the first side when the pivoting element and the toggle lever are in the second configuration.

51. The strapping device of claim 43, wherein the drive device comprises a motor.

52. The strapping device of claim 51, wherein the motor comprises a brushless direct current motor.

53. The strapping device of claim 51, wherein the motor comprises a motor shaft operably connected to the tensioning wheel, the strap connector, and the pivoting element.

54. The strapping device of claim 53, further comprising a control device configured to control the motor to rotate the motor shaft in:

a first rotational direction to cause the pivoting element and the toggle lever to move from the first configuration to the second configuration to move the strap connector from the rest position downward to the connecting position and to cause the strap connector to operate; and a second rotational direction opposite the first rotational direction to cause the tensioning wheel to rotate.

55. The strapping device of claim 43, wherein the strap connector comprises a welding shoe, a welding shoe arm housing the welding shoe, and an eccentric drive operably connected to the welding shoe to cause the welding shoe to oscillate.

56. The strapping device of claim 55, wherein the drive device is operably connected to the eccentric drive to rotate the eccentric drive to cause the welding shoe to oscillate.

57. The strapping device of claim 56, further comprising an output gear and an endless belt operably connecting the output gear to the eccentric drive to rotate the eccentric drive, wherein the drive device is operably connected to the output gear to rotate the output gear.

58. The strapping device of claim 43, further comprising a rocker lever operable to cause the pivoting element and the toggle lever to move from the second configuration to the first configuration, thereby moving the strap connector from the connecting position upward to the rest position.

59. The strapping device of claim 58, wherein the spring circumscribes at least part of the toggle lever.

60. The strapping device of claim 36, wherein the toggle lever comprises a first end coupled to the pivoting element and a second end coupled to the strap connector, and wherein the spring is configured to, when the pivoting element and the toggle lever are in the second configuration, force the first and second ends of the toggle lever away from one another to exert a first force on the pivoting element and a second force on the toggle lever.

* * * * *